US006286901B1

(12) United States Patent
Ritch et al.

(10) Patent No.: US 6,286,901 B1
(45) **Date of Patent: *Sep. 11, 2001**

(54) CHAIR

(75) Inventors: David J. Ritch, Malibu; Mark Saffell, Manhattan Beach; Steven P. Vassallo, Palo Alto; Alan M. Vale, Sunnyvale; Kristine R. Chan-Lizardo, Redwood City, all of CA (US); Robert L. Stewart, Grapevine, TX (US)

(73) Assignee: Steelcase Development Inc., Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/638,733

(22) Filed: Aug. 14, 2000

Related U.S. Application Data

(63) Continuation of application No. 09/399,572, filed on Sep. 20, 1999, which is a continuation of application No. 09/079, 531, filed on May 15, 1998, now Pat. No. 6,030,037.

(51) Int. Cl.[7] ..... A47C 3/04

(52) U.S. Cl. ..... 297/313; 297/239; 297/331; 297/335; 297/338; 297/344.19

(58) Field of Search ..... 297/313, 239, 297/331, 335, 338, 344.19

(56) References Cited

U.S. PATENT DOCUMENTS

| | | | |
|---|---|---|---|
| D. 272,204 | 1/1984 | De Boer . | |
| D. 272,205 | 1/1984 | De Boer . | |
| 453,914 | 6/1891 | Ramsey | 297/335 |
| 1,758,826 | 5/1930 | Dellert | 297/239 |
| 1,941,340 | 12/1933 | Dellert | 297/239 |
| 2,004,934 | 6/1935 | Dellert | 297/239 |

(List continued on next page.)

FOREIGN PATENT DOCUMENTS

| | | | |
|---|---|---|---|
| 493316 | 10/1938 | (GB) . | |
| 888174 | 1/1962 | (GB) | 297/239 |
| 301165 | 3/1997 | (TW) . | |
| WO 92/22231 | 12/1992 | (WO) . | |

OTHER PUBLICATIONS

Krueger International, "Torsion on the Go", Available at http://www.kruegerinternational/c showroom/mid 4.0 html, bearing a designation of "Jul. 29, 2000 4:04 PM" (3 Sheets).
Advertisment entitled "Spontaneous Seating", on p. 165 of the Apr. 1998, vol. 186, No. 4, "Architectural Record" magazine, showing the Torsion Chair from KI.
Article, "Knoll Spins Propellers", (undated) (2 color sheets).
Busch, Jennifer Thiele, Bring You folding Chairs, Contract Design, Aug. 1998, p. 23.

(List continued on next page.)

*Primary Examiner*—Jose V. Chen
*Assistant Examiner*—Rodney B. White
(74) *Attorney, Agent, or Firm*—Foley & Lardner

(57) ABSTRACT

A system of nestable chairs for use in a work environment is disclosed. The system includes a plurality of chairs. Each chair includes a base, a support coupled to the base, and a seat assembly coupled to the support and adapted for pivotal movement and for vertical adjustment with respect to the base. The base of a first chair of the plurality of chairs is configured to allow for nesting within the base of a second chair of the plurality of chairs. A chair for use in a work space or the like is also disclosed. The chair includes a base having a nesting portion and a nested portion, a support coupled to the base, and a seat assembly coupled to the support and adapted for pivotal movement and for vertical adjustment with respect to the base. The nested portion of the base is configured to allow for nesting within the nesting portion of the base. The chair may also include a support in the form of a pedestal coupled to the base. A yoke may be coupled to the pedestal, with the seat assembly coupled to the yoke and adapted for pivotal movement and for vertical adjustment with respect to the base.

130 Claims, 15 Drawing Sheets

U.S. PATENT DOCUMENTS

| | | | |
|---|---|---|---|
| 2,011,067 | 8/1935 | McKee | 297/239 |
| 2,055,340 | 9/1936 | Dellert . | |
| 2,146,932 | 2/1939 | Boman | 297/239 |
| 2,509,395 | 5/1950 | Madan . | |
| 2,737,230 | 3/1956 | Mackintosh | 297/239 |
| 2,874,755 | 2/1959 | Smith | 297/239 |
| 3,028,197 | 4/1962 | Wilson | 297/239 X |
| 3,087,755 | 4/1963 | Boman | 297/239 |
| 3,203,731 | 8/1965 | Krueger | 297/239 |
| 3,451,718 | 6/1969 | Kaufman | 297/239 |
| 3,847,433 | 11/1974 | Acton et al. | 297/239 |
| 3,899,207 | 8/1975 | Müller | 297/239 |
| 3,982,785 | 9/1976 | Ambasz | 297/239 X |
| 4,018,479 | 4/1977 | Ball | 297/239 X |
| 4,057,288 | 11/1977 | Schwartz et al. | 297/239 X |
| 4,067,606 | 1/1978 | Desmoulins Fouchereau et al. | 297/239 X |
| 4,240,663 | 12/1980 | Locher | 297/239 |
| 4,639,012 | 1/1987 | Jensen . | |
| 4,749,232 | 6/1988 | Guichon | 297/239 X |
| 4,793,654 | 12/1988 | Takafuji | 297/338 |
| 5,037,116 | 8/1991 | Desanta | 297/239 X |
| 5,060,967 | 10/1991 | Hulterstrum | 280/650 |
| 5,096,259 | 3/1992 | Stanfield | 297/239 |
| 5,106,157 | 4/1992 | Nagelkirk et al. . | |
| 5,547,252 | 8/1996 | Pfenniger | 297/344.19 X |
| 5,609,390 | 3/1997 | Takafuji | 297/338 X |
| 5,738,408 | 4/1998 | Wu | 297/239 |
| 5,800,015 | 9/1998 | Tsuchiya et al. | 297/331 |
| 5,836,555 | 11/1998 | Ellsworth et al. | 297/344.18 X |
| 5,868,469 | 2/1999 | Ming | 297/338 |
| 6,030,037 | 2/2000 | Ritch et al. | 297/239 |
| 6,142,566 * | 11/2000 | Ritch et al. | 297/239 |

OTHER PUBLICATIONS

"KI Newest Products–Torsion On Wheels", printed from Internet site address www.kiinc.com/latest/NewProducts/torsion.html,bearing a date of "Apr. 16, 1998" (2 sheets).

International Search Report for PCT/US 99/10430 dated Aug. 6, 1999 (3 sheets).

* cited by examiner

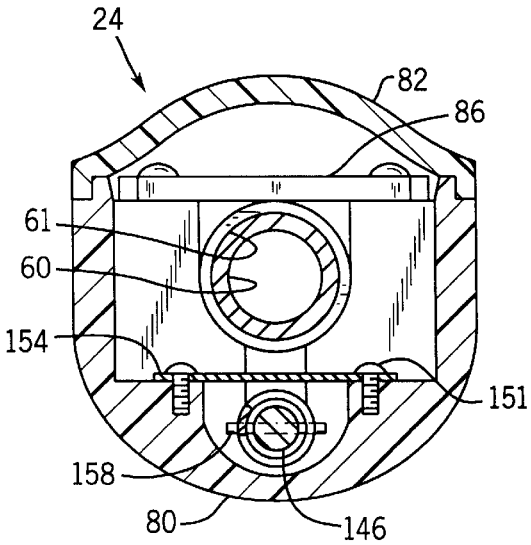
FIG. 14
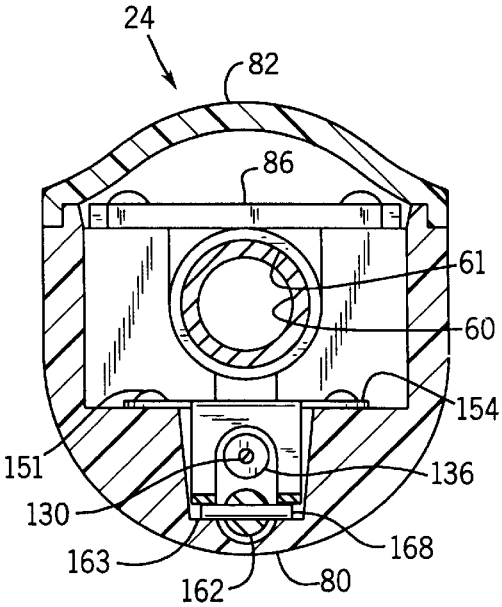
FIG. 11
FIG. 12
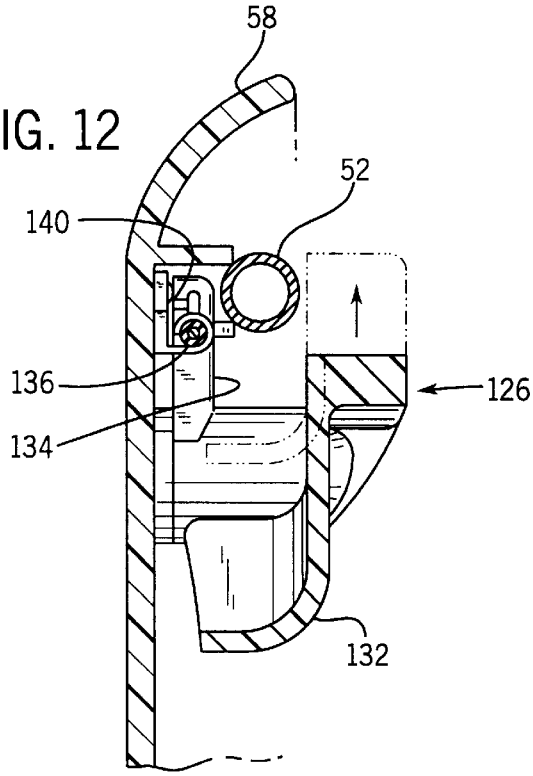
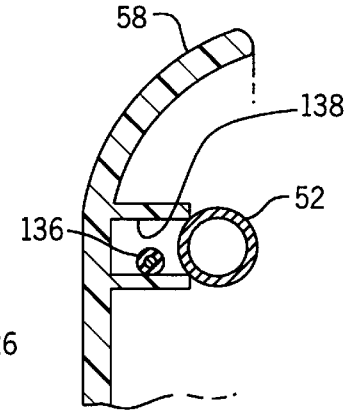
FIG. 13

FIG. 15
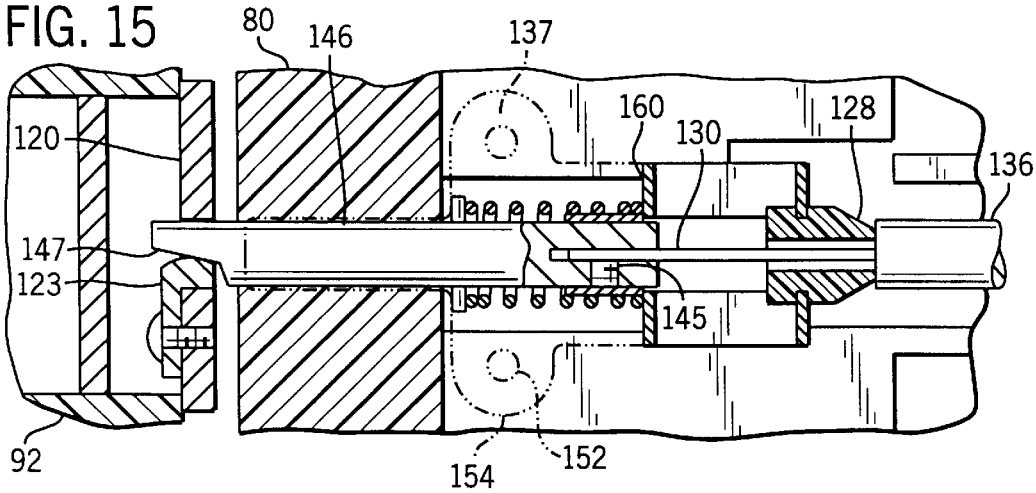
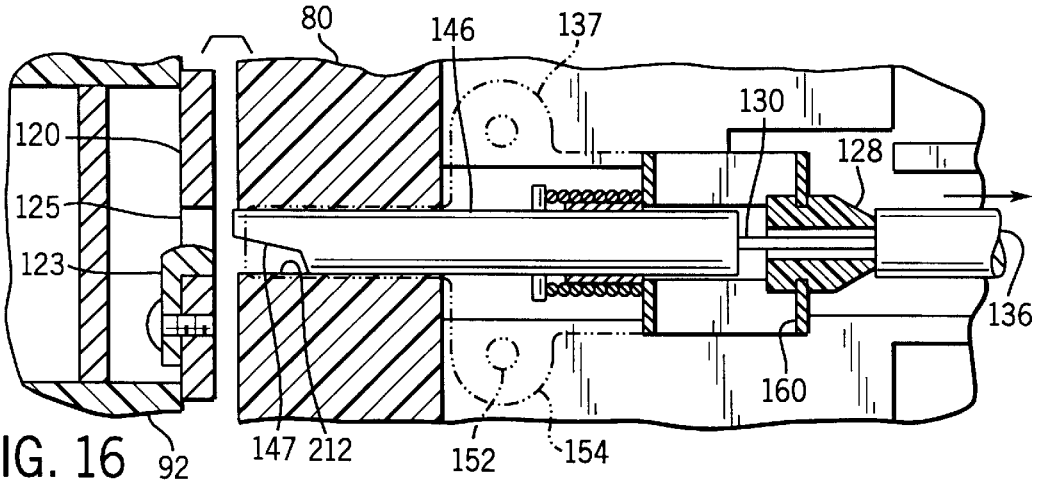
FIG. 16
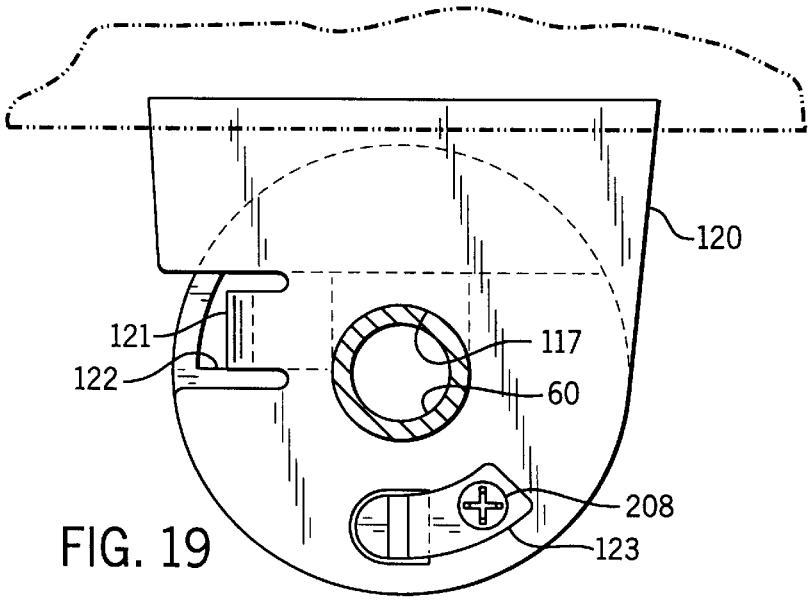
FIG. 19

FIG. 20
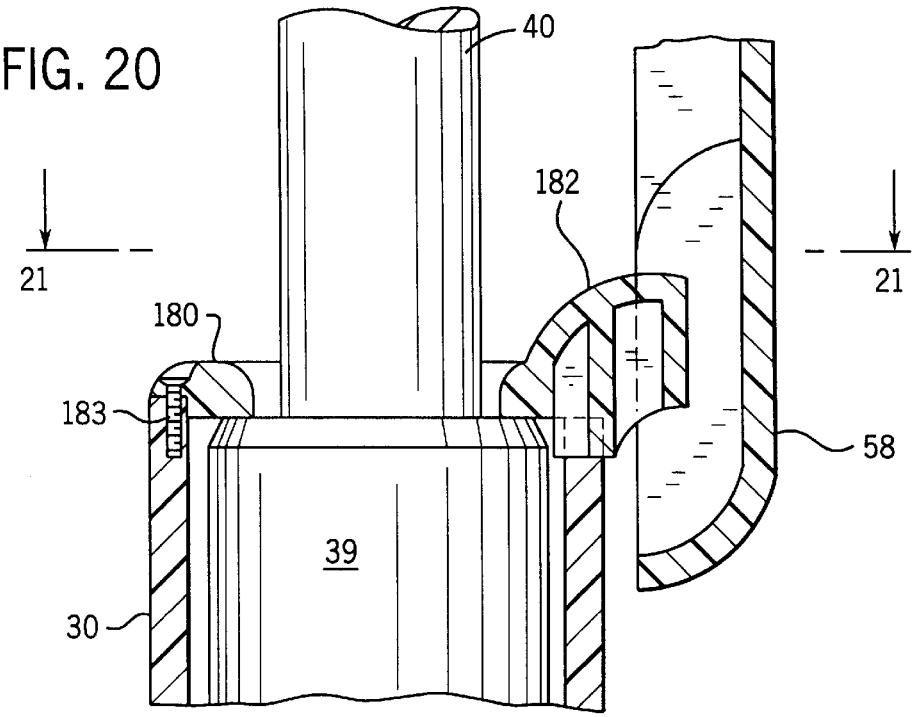
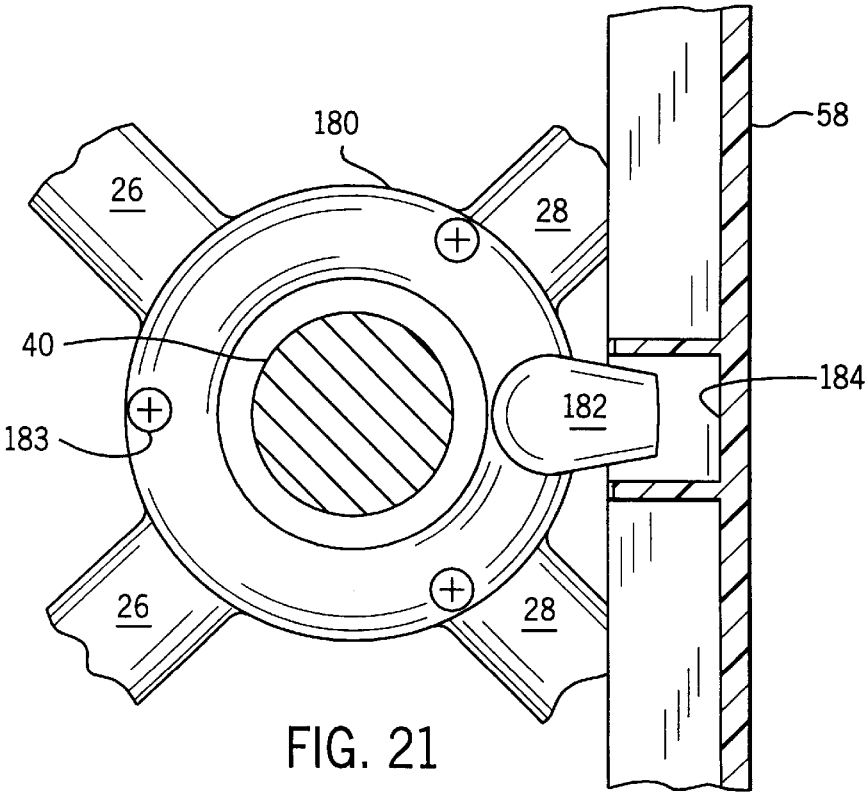
FIG. 21

CHAIR

RELATED APPLICATION

The present application is a continuation of co-pending U.S. patent application Ser. No. 09/399,572 filed Sep. 20, 1999 which was a continuation of U.S. patent application Ser. No. 09/079,531 filed May 15, 1998, which issued as U.S. Pat. No. 6,030,037, the disclosure of which is hereby incorporated by reference.

FIELD OF THE INVENTION

The present invention relates to a chair. In particular, the present invention relates to a chair that is configured to provide for a horizontal nesting arrangement.

BACKGROUND OF THE INVENTION

It is known to provide for a nestable chair or system of nestable chairs, in which, for purposes of compact storage, one chair is received within another chair. Arrangements for vertically nestable or "stacking" chairs, where one chair is fitted atop another chair to form a vertical stack of chairs, are well-known. Typically, such vertically nestable chairs will include a generally orthogonal base (i.e. a "box"-shaped base consisting of at least two and typically four base supports), which is configured so that one chair can be fitted onto another chair in a compact arrangement, with the base of the upper chair fitting over the seat of the lower chair. Such chairs may provide for compact storage but yet are generally uncomfortable for seating and can be unwieldy, e.g. clumsy to handle during nesting or stacking. Transport of such stacked chairs can be particularly difficult, and a separate cart or the like may be required.

Arrangements for horizontally nestable chairs, where one chair is fitted into another chair to form a horizontal line of chairs, are also known. Such horizontally nestable chairs typically also include a generally orthogonal base (i.e. consisting of at least two base supports). Such chairs also may tend to be uncomfortable for seating and unwieldy, and may not readily or easily be nested in a uniform manner. Transport of the nested chairs may also be rather difficult.

Folding chairs, where the seat of the chair can be folded onto the base or back support of the chair, are also known. According to any typical arrangement, such folding chairs will not provide for any type of adjustment of the seat or back support with respect to the base during ordinary use. Such folding chairs also tend to be rather uncomfortable for seating. Moreover, such folding chairs tend to be difficult to manage for purposes of storage, sometimes requiring additional structures such as racks or carts.

As has been noted, such known arrangements for nestable and folding chairs are intended to provide for compact storage and space savings, and may generally achieve that purpose. However, these known arrangements typically achieve compact storage and space savings only at the sacrifice of overall functionality, i.e. comfort, adjustability, ease of use, transportability, etc. Moreover, these known arrangements for nestable and folding chairs by their very nature also tend to limit aesthetic design possibilities.

Accordingly, it would be advantageous to have a horizontally nestable chair and/or a system of nestable chairs that provides not only for relatively compact storage but also for enhanced functionality, for example, the functionality generally associated with a "task chair" or "office chair" (i.e., pivotal rotation of the seat assembly with respect tco the base and/or vertical adjustment of the seat height). It would also be advantageous to have a horizontally nestable chair that can be configured for nesting and thereafter uniformly nested with relative ease. It would further be advantageous to provide for a system of horizontally nestable chairs that can be formed into an orderly "train" of nested chairs for purposes of transport and/or compact storage.

SUMMARY OF THE INVENTION

The present invention relates to a system of nestable chairs for use in a work environment including a plurality of chairs. Each chair includes a base, a support coupled to the base, and a seat assembly coupled to the support and adapted for vertical adjustment with respect to the base. The base of a first chair of the plurality of chairs is configured to allow for nesting within the base of a second chair of the plurality of chairs.

The present invention also relates to a chair for use in a work space or the like. The chair includes a base having a nesting portion and a nested portion, a support coupled to the base, and a seat assembly coupled to the support and adapted for vertical adjustment with respect to the base. The nested portion of the base is configured to allow for nesting within the nesting portion of the base.

The present invention further relates to a chair for use in a work space or the like. The chair includes a base having a nesting portion and a nested portion, a pedestal coupled to the base, a yoke coupled to the pedestal, and a seat assembly coupled to the yoke and adapted for pivotal movement and for vertical adjustment with respect to the base. The nested portion of the base is configured to allow for nesting within the nesting portion of the base.

The present invention further relates to a chair for use in a work space or the like. The chair includes a base having a nesting portion and a nested portion, a support coupled to the base, and a seat assembly coupled to the support including a back and a back tension adjustment mechanism. The nested portion of the base is configured to allow for nesting within the nesting portion of the base.

BRIEF DESCRIPTION OF THE DRAWINGS

FIG. 11 is a sectional elevation view of the yoke of the chair taken along line 11—11 in FIG. 7.

FIG. 12 is a sectional elevation view of the seat of the chair taken along line 12—12 in FIG. 5.

FIG. 13 is a sectional elevation view of the seat of the chair taken along line 13—13 in FIG. 5.

FIG. 14 is a sectional elevation view of the yoke of the chair taken along line 14—14 in FIG. 7.

FIG. 15 is a sectional view of the yoke of the chair taken along line 15—15 in FIG. 7 showing the latch mechanism in an engaged position.

FIG. 16 is a sectional plan view showing the latch mechanism of FIG. 15 in a release position.

FIG. 19 is a sectional elevation view of the yoke of the chair taken along line 19—19 in FIG. 7.

FIG. 20 is a plan view of the pedestal of the chair taken along line 20—20 in FIG. 7.

FIG. 21 is a sectional elevation view of the pedestal of the chair taken along line 21—21 in FIG. 20.

DETAILED DESCRIPTION OF THE PREFERRED EMBODIMENTS

Figure 1:
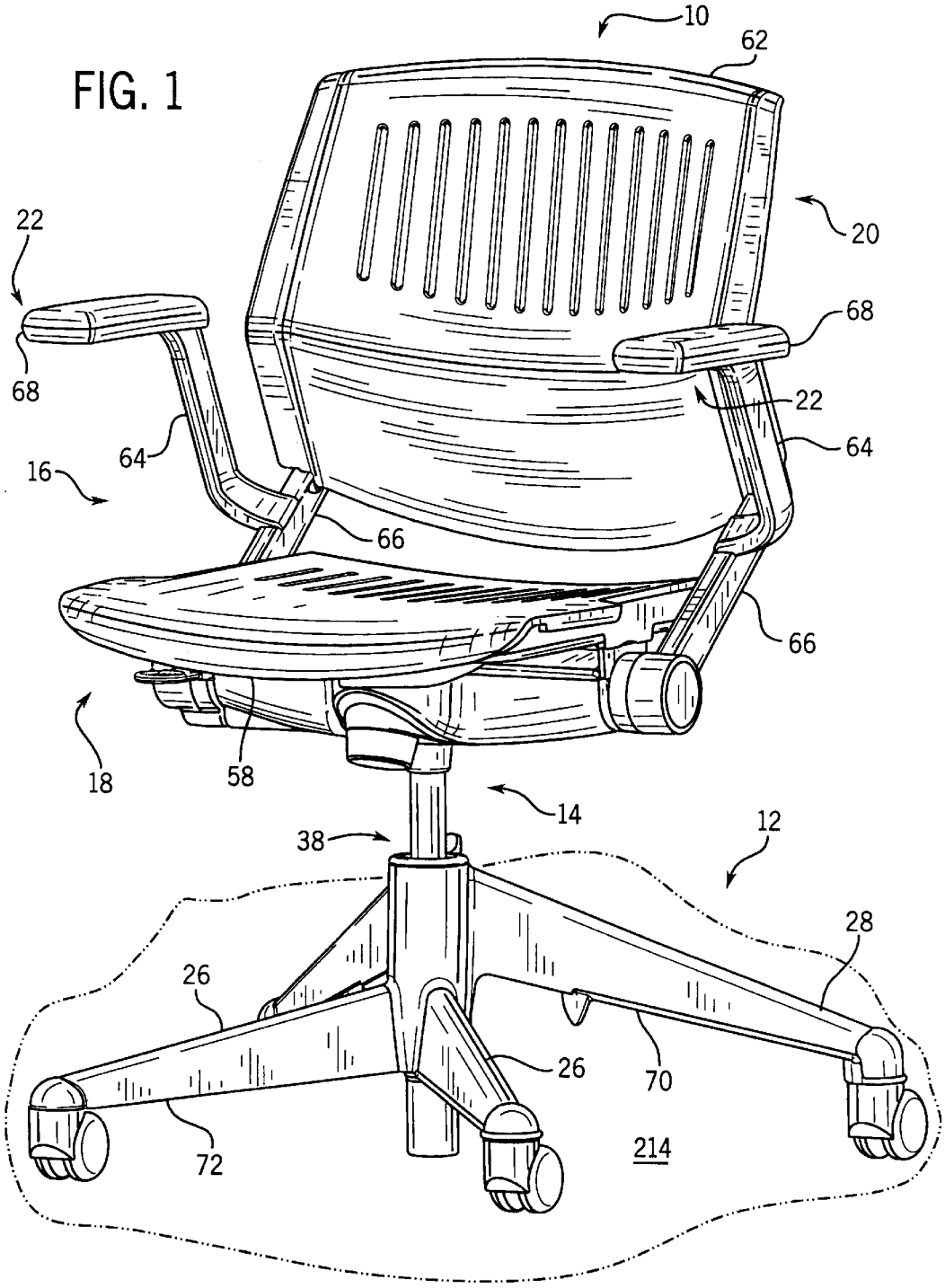
FIG. 1 is a perspective view of a chair according to a preferred embodiment of the present invention.
Figure 2:
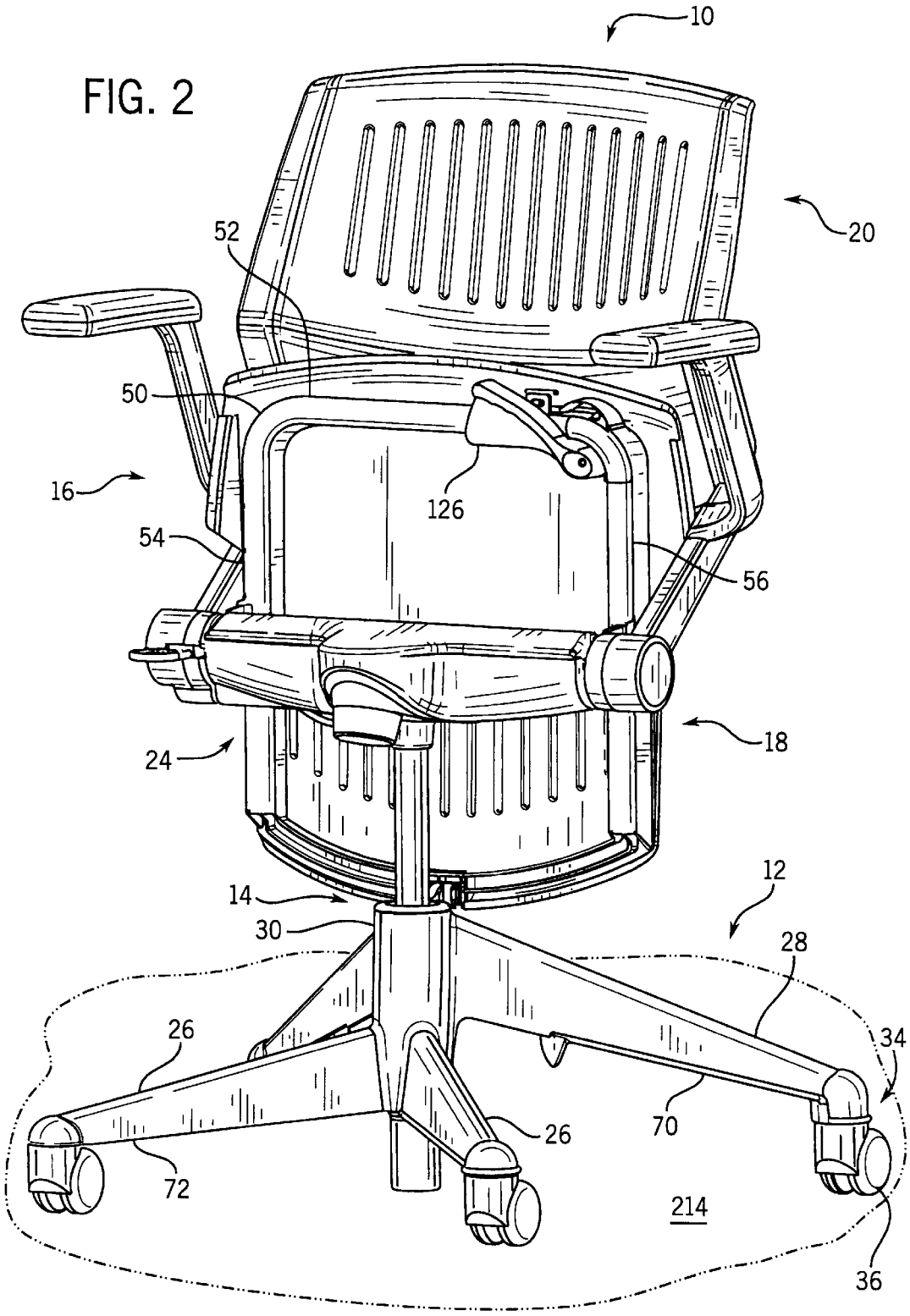
FIG. 2 is a perspective view of the chair with a seat in a stowed position.

Referring to the FIGS. 1 and 2, a chair 10 is shown according to a preferred embodiment of the present invention. Chair 10 includes a base 12 providing a pedestal 14, a seat assembly 16, including a seat 18 and a back support 20. Chair 10 also has arms 22 (which may be omitted according to an alternative embodiment). Seat assembly 16 also includes a yoke 24 to which seat 18 and back support 20 are coupled. Seat assembly 16 is coupled to base 12 through a support assembly including yoke 24, which is installed onto pedestal 14 of base 12 (see FIG. 10).

Figure 22:
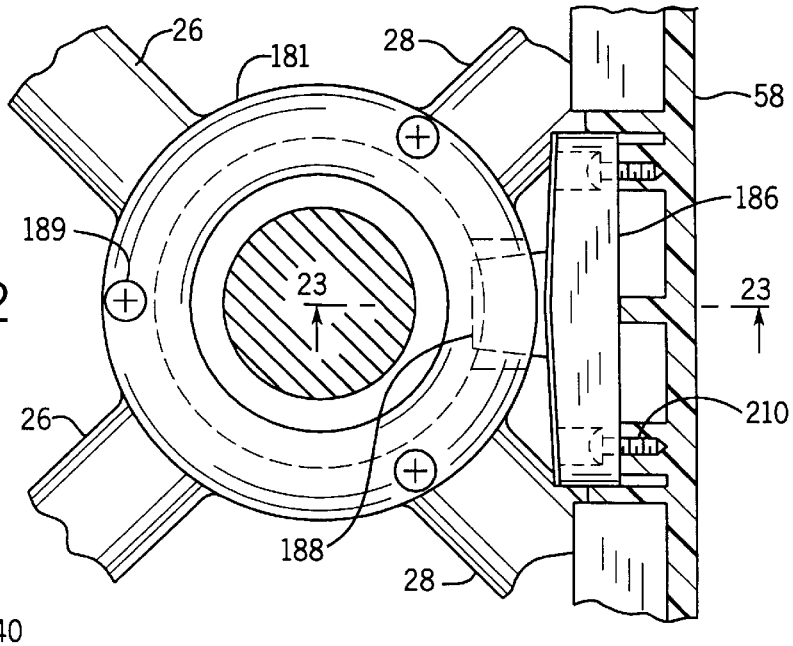
FIG. 22 is a sectional plan view of the pedestal of the chair according to an alternative embodiment.
Figure 23:
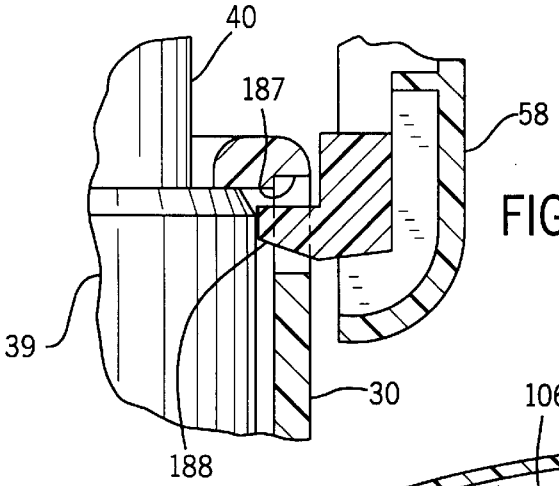
FIG. 23 is a sectional elevation view of the pedestal of the chair taken along line 23—23 in FIG. 22.

Base 12 is of a generally symmetrical star-shaped configuration (see FIG. 22) having two identical front legs 26 and two identical rear legs 28 extending radially outward from a hollow structural tube 30 (e.g. central core). Each of front legs 26 and rear legs 28 has a foot 32 at which is installed a rotatable caster 34 providing a rotating wheel 36. Chair 10 may thus roll along a floor 214.

Figure 7:
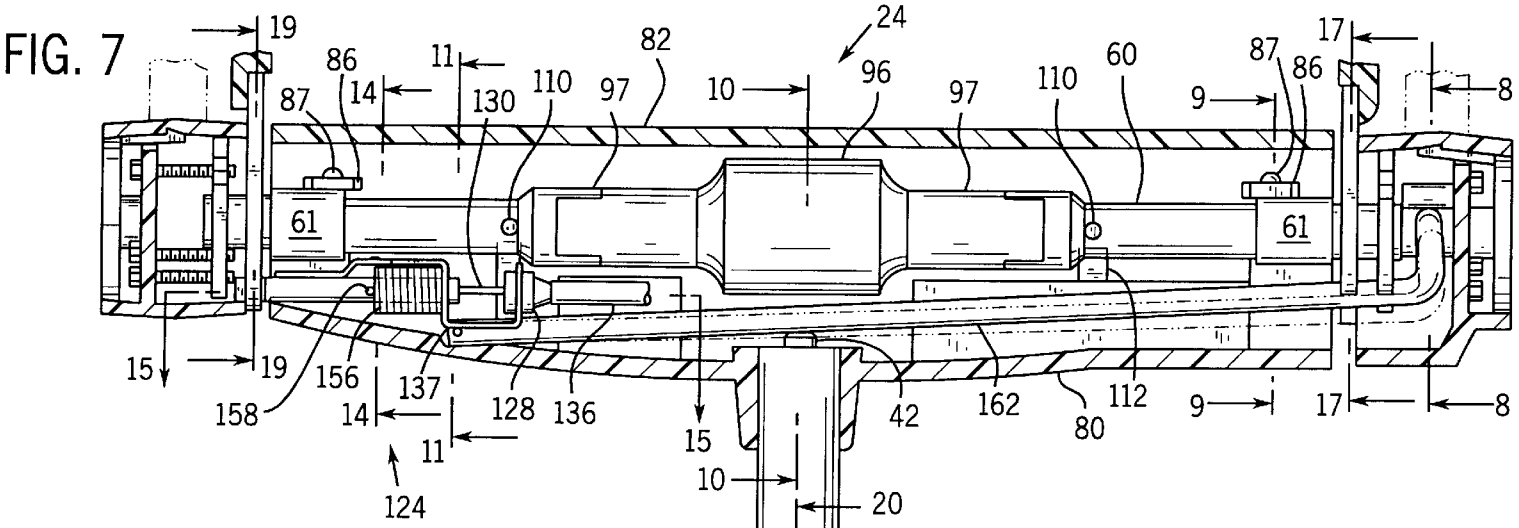
FIG. 7 is a sectional elevation view of the yoke and the pedestal of the chair taken 7 in FIG. 5.

A gas or pneumatic cylinder 38 is fixedly installed within tube or core 30 of base 12 (and is partially visible in FIG. 7). According to any particularly preferred embodiment, pneumatic cylinder 38 (or gas spring) is of a conventional arrangement having a body 39 and an actuator or strut 40 that can be extended from or retracted into body 39 when a release valve mechanism (shown as actuated by a button 42 at the top of strut 40) is depressed; strut 40 is also essentially free to rotate within body 39 of pneumatic cylinder 38 about a central axis 44 (centrally projecting through strut 40) without substantial frictional resistance.

Figure 1A:
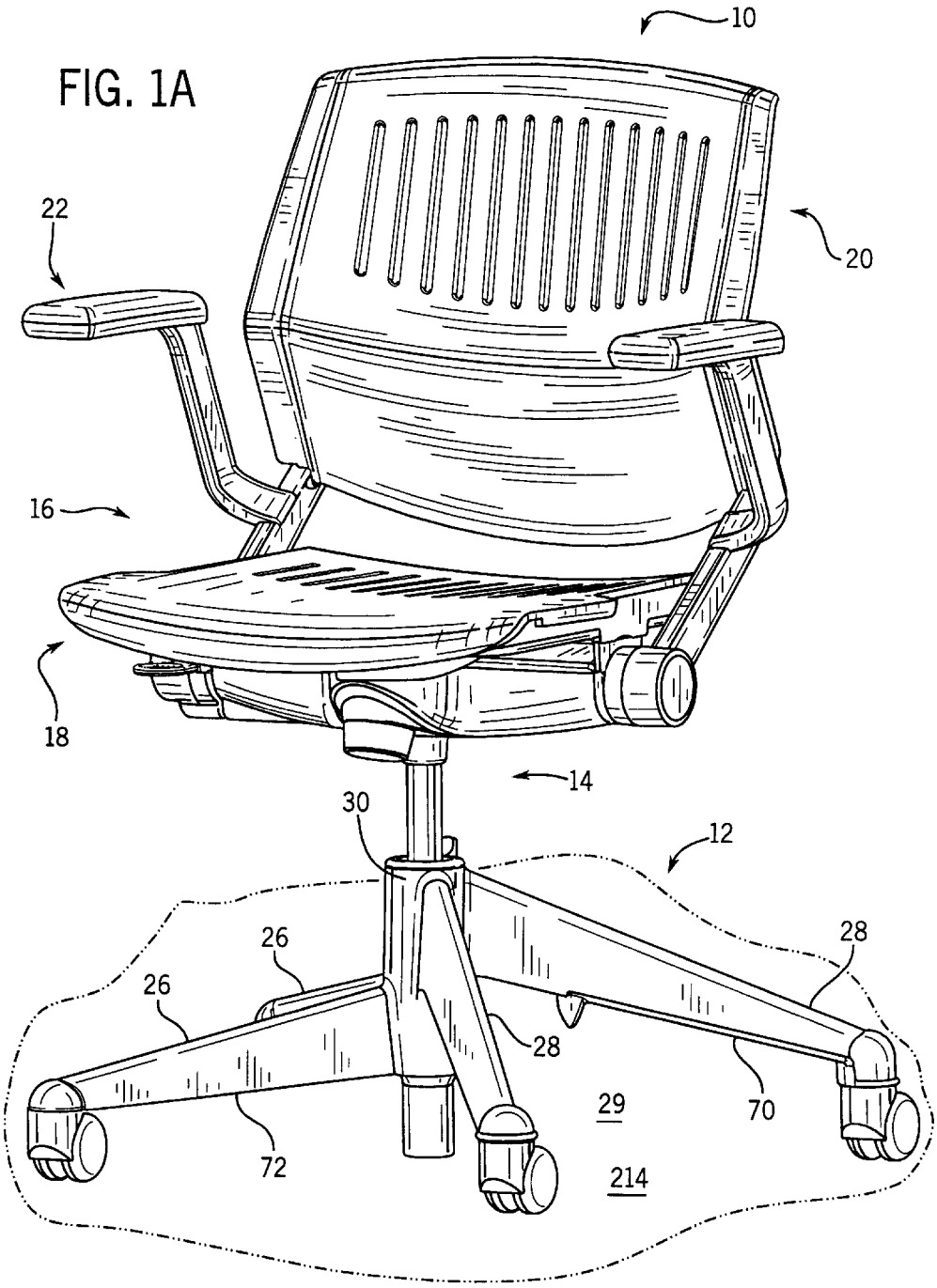
FIG. 1A is a perspective view of the chair.

Yoke 24 is coupled to pedestal 14 at strut 40 to provide for both pivotal rotation of seat assembly 16 with respect to base 12 about central axis 44 and height adjustment of seat assembly 16 along central axis 44 of base 12. (According to a particularly preferred embodiment shown in FIG. 10 and steel strut 40 of base 12 has a tapered upper end 46 which is fixedly installed within a corresponding tapered bushing 48 within the bottom of yoke 24 so that button 42 of the release valve mechanism projects into the center of yoke 24.) Pivotal rotation of seat assembly 16 with respect to base 12 (i.e. about central axis 44) is provided by the rotation of strut 40 within body 39 of pneumatic cylinder 38 (compare FIG. 1 and FIG. 1A). Height adjustment of seat assembly 16 with respect to base 12 is provided by strut 40 of pneumatic cylinder 38, which is configured to retract into body 39 of pneumatic cylinder 38 or to extend from body 39 of pneumatic cylinder 38 within a predefined path of travel along central axis 44 (compare FIG. 1 and FIG. 2). As shown in FIGS. 1 and 2, the height of seat assembly 16 can thereby be adjusted within a range of motion between a fully extended state and a fully retracted state, providing the user of the chair with a range of vertical seating positions between the two states.

Referring to FIGS. 1 and 2, the general arrangement of the coupling of seat 18 and back support 20 of seat assembly 16 to yoke 24 of chair 10 is shown. Seat 18 of chair 10 includes a mounting structure shown as a "U"-shaped seat tube 50 having a cross member 52 coupling two parallel lateral members 54 and 56. Seat tube 50 also provides a mounting structure for a seat outer shell 58. As shown in FIGS. 1 and 2, seat 18 (through its mounting structure) is pivotally coupled to yoke 24. Yoke 24 includes a transverse axle (provided with reference numeral 60 but not shown in FIGS. 1 and 2) defining a transverse axis 45 about which seat 18 can be pivoted from an "in use" position (as shown in FIG. 1) to a stowed position (as shown in FIG. 2). Back support 20 of seat assembly 16 includes a pair of support members 66 coupled to the transverse axle (not shown in FIGS. 1 and 2) and extending from lateral ends of yoke 24. Support members 66 also provide a frame within which a back outer shell 62 of back support 20 is installed (back outer shell 62 may also include a mounting frame, see FIG. 24). During the use of chair 10, back support 20 is rotatable through support arms 22 about transverse axis 45 defined by the transverse axle of yoke 24 within a predetermined path of travel (and under a predetermined amount of tension). Arm supports 64 extend from each of support members 66 to provide a generally horizontal mounting structure 68 for mounting of each of arms 22 (which may be upholstered according to any preferred embodiment). According to any preferred embodiment, an upholstered (e.g. fabric and foam) or other type of outer surface can be mounted to the seat outer shell or the back outer shell, which are made of a substantially rigid plastic material.

Figure 4:
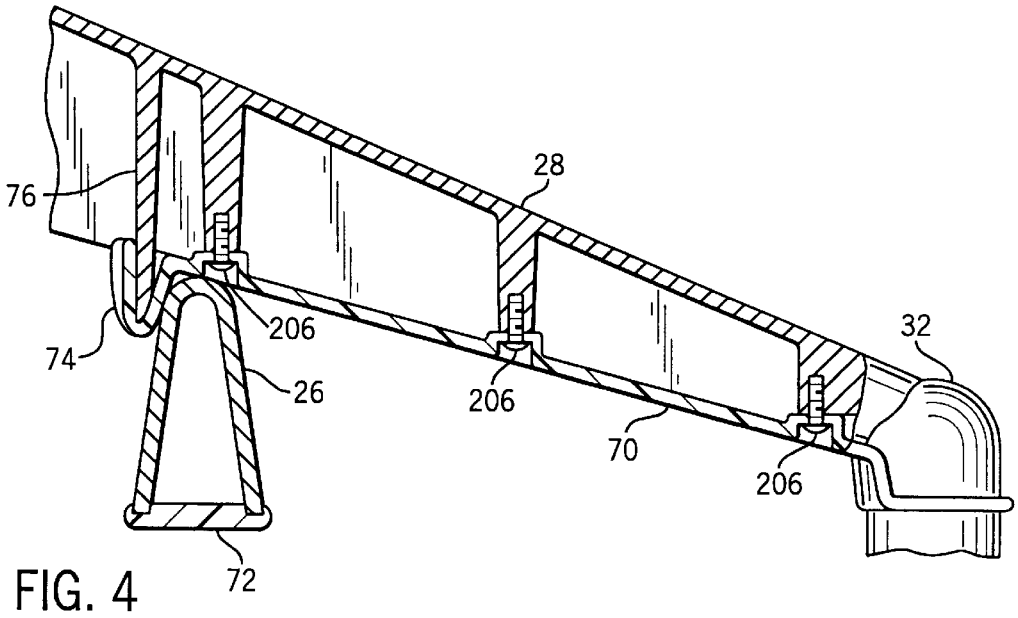
FIG. 4 is a fragmentary elevation view of a leg of the base of chair.

Rear legs 28 of base 12 are provided with a rear leg rub strip 70; front legs 26 of base 12 are provided with front leg rub strips 72; the rub strips 70 and 72 are made of a durable plastic material and are intended to shield and protect each of front legs 26 and rear legs 28. According to an exemplary embodiment (see FIG. 4), each rub strip 70 is "captured" between foot 32 and caster 34 and secured at the underside of leg 28 by fasteners (shown as screws 206 that are threaded into structural sections of the leg). Rear leg rubk strips 70 extend only partially along the underside of realegs 28 and include a projection 74 (also called a "shark's tooth") at the inner ends. As shown in FIG. 4, projection 74 of each rear leg rub strip 70 fits onto a backing member 76. extending from the underside of rear leg 28.

According to any preferred embodiment, the chairs are configured to provide for a nesting arrangement, with one chair being horizontally nestable within another chair. As is apparent from the particularly preferred embodiment shown in FIG. 3, the nesting arrangement can be facilitated by one or more features of the chair. The chair can be provided with a seat-activated mechanism so that the seat assembly is; automatically set to a predetermined height with respect to the base when the seat is rotated to the stowed position; as a result, the seat assembly of each of the chairs to be nested will be in a uniform height well-suited for purposes of nesting. The chair can be provided with a locking (or other "registration" mechanism) so that the rotational position of the seat assembly with respect to the base can be fixedly oriented; as a result, the seat assembly of each of the chairs to be nested will be in a uniform rotational orientation well-suited for purposes of nesting. The chair can be provided with a base that is configured to provide for a secure nestable "fit" of one chair within another chair for purposes of nesting.

Figure 3:
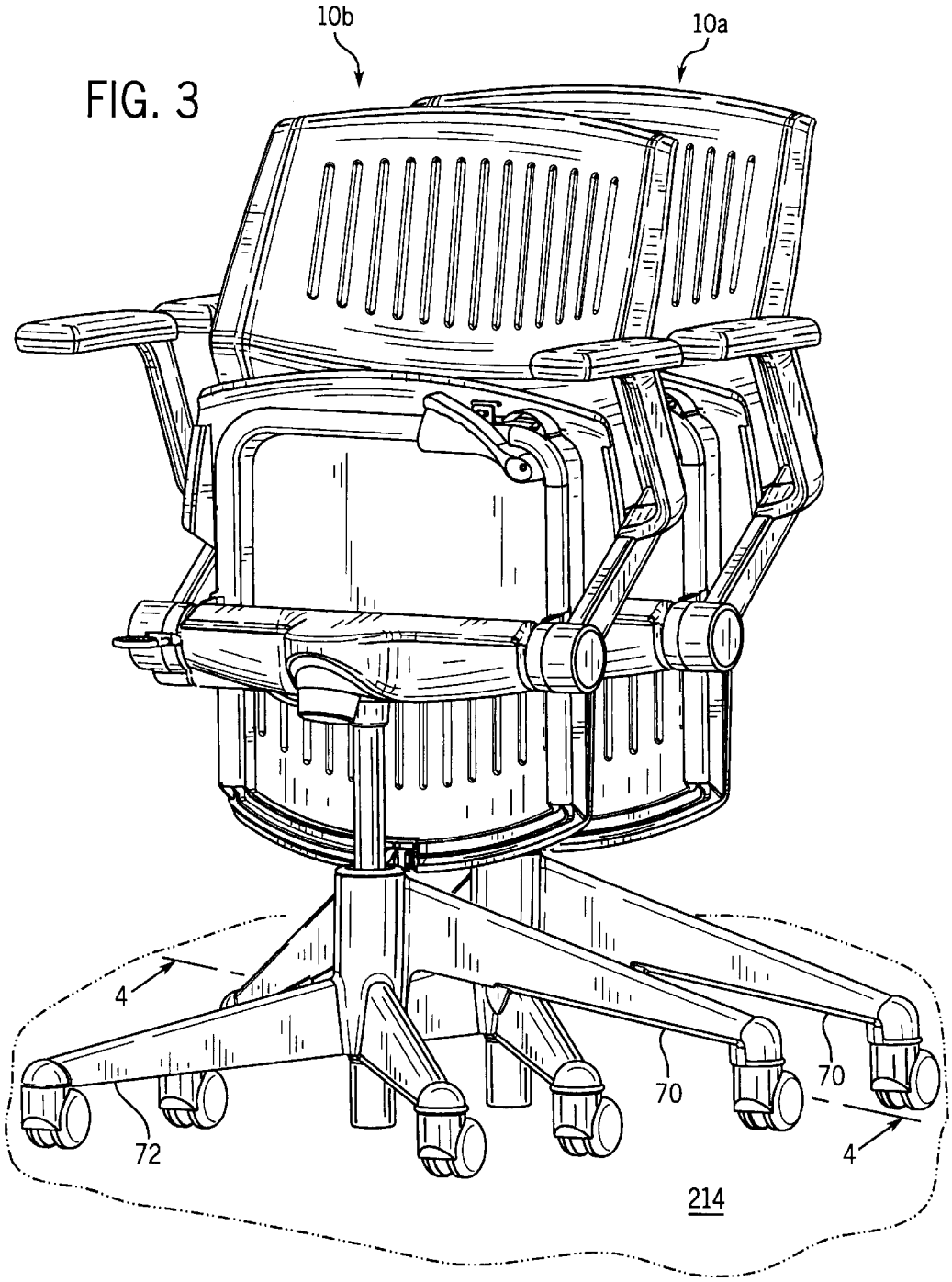
FIG. 3 is a perspective view of two chairs in a nested arrangement.

Referring to the FIGURES and specifically to FIG. 3, the configuration of base 12 of chair 10 is shown according to a particularly preferred embodiment. Rear legs 28 of chair lob are configured to form a receiving area or receptacle 29 within which front legs 26 of chair 10*a* can be received (see also FIG. 1A). Rear legs 28 are raised with respect to front legs 26; rear legs 28 and front legs 26 also have a tapered profile. Front legs 26 of one chair 10*a* therefore "fit" underneath rear legs 28 of another chair 10*b* (and are received within the receptacle 29 formed between each of rear legs 28), being "centered" by and guided along the corresponding tapered profiles, when chair 10*a* is rolled into chair 10*b* for purposes of nesting. Rear leg rub strips 70 of each of rear legs 28 of chair 10*b* serve to protect each of front legs 26 of chair 10*a* from damage during nesting; projection 74 of each of rear leg rub strips 70 serves to provide a "stop" for the travel of front legs 26 beneath rear legs 28 during nesting. As shown in FIG. 3, when each of front legs 26 of chair 10*a* has come into contact with each corresponding projection 74 of rear leg rub strips 70 of rear legs 28 of chair 10*b*, chair 10*a* is securely "nested" within chair 10*b*.

As shown in FIG. 3, the nesting of the chairs is provided for in a uniform, aligned and repeatable nesting arrangement. According to any particularly preferred embodiment, any number of chairs can be horizontally nested, as to form a "train" of nested chairs (which can be rolled across a floor within an office environment or the like for purposes of storage and/or maintenance).

Referring to FIGS. 5 through 10, detail of yoke 24 and associated structures is shown. Yoke 24 includes a yoke housing 80 (shown in phantom lines in FIG. 5) and a yoke cap 82 which is mounted thereto. Installed within yoke housing 80 is transverse axle 60 which extends across yoke 24 to provide pivotal couplings for back support 20 and seat 18.

Figure 9:
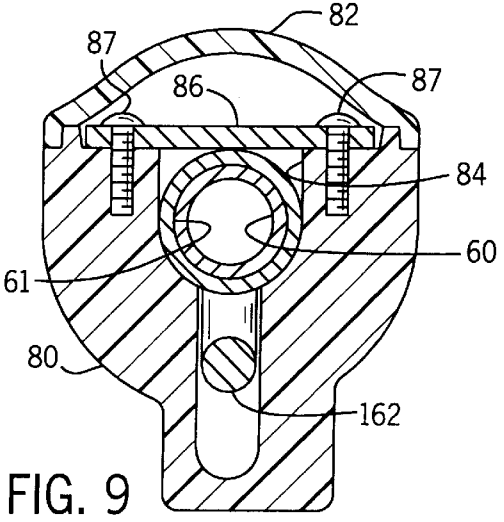
FIG. 9 is a sectional elevation view of the yoke of the chair taken along line 9—9 in FIG. 7.

Axle 60 (a hollow metal tube according to any preferred embodiment) is rotatable within a predetermined range of motion within yoke housing 80. As shown in FIG. 9, axle 60 is seated at each end within a bearing 61 (i.e. a bronze bushing or the like) in a nest 84 formed in yoke housing 80 and retained by an axle strap 86 secured to yoke housing 80 by fasteners shown as screws 87. (According to an alternative embodiment, the bearings at each end of the axle may be omitted and the axle may be journaled directly within a suitable nest or in a bracket within yoke housing.)

Figure 6:
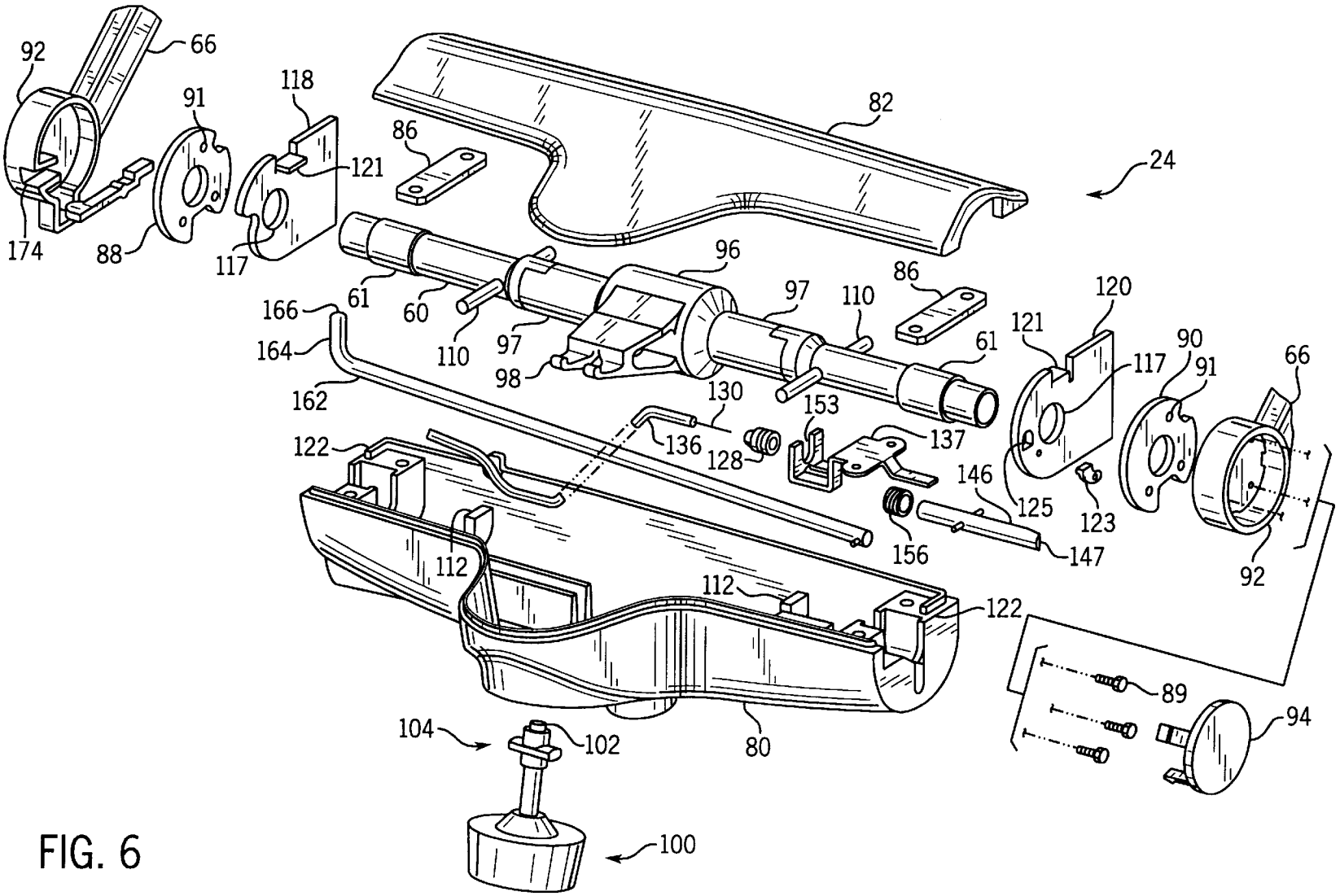
FIG. 6 is an exploded perspective view of the yoke of the chair.

Referring to FIG. 6, end plates 88 and 90 are mounted to each end of axle 60. Each of end plates 88 and 90 provides for mounting to a circular cap 92 which provides a mounting structure at the end of each of support members 66 of back support 20 (fasteners shown as screws 89 are threaded into mounting holes 91). By securing circular caps 92 of support members 66 to end plates 88 and 90, back support 20 is coupled to axle 60 for rotational movement during use of the chair. A hub cap 94 is snapped into a open central portion of each circular cap 92.

Figure 10:
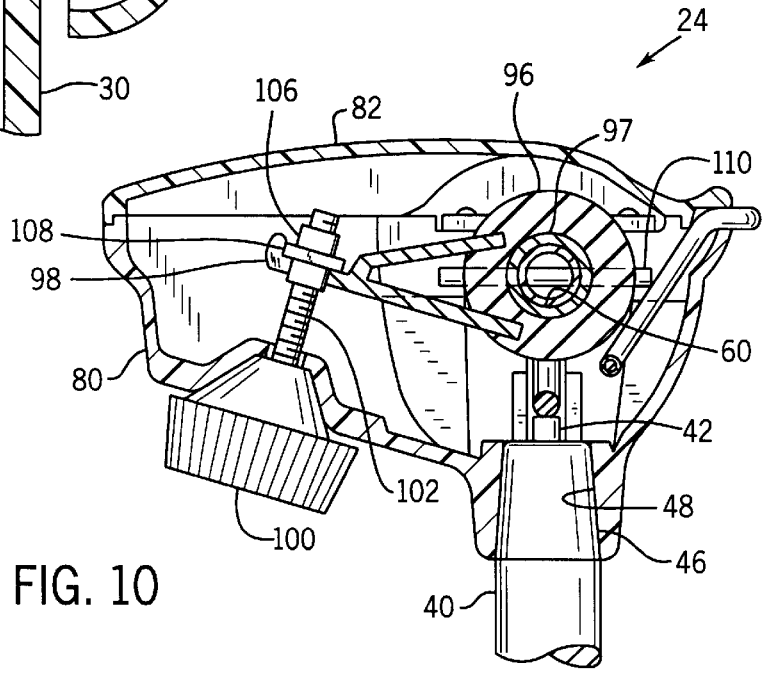
FIG. 10 is a sectional elevation view of the pedestal of the chair taken along line 10—10 in FIG. 7.

Rotation of axle 60 is restrained or controlled by a tensioning mechanism shown as a torsion spring 96 (also referred to as a "rubber pack" having a compliant rubber core). Torsion spring 96 is mounted to axle 60 (i.e. by tack welding or the like at each end of an associated bushing 97) and coupled to yoke housing 80 through a clevis 98. As shown in FIG. 10, an adjustment knob 100 having a threaded end 102 extends extends through a fitting 104 in yoke housing 80 and is threadably coupled to clevis 98 (through a nut 106 and bar washer 108). Rotation of adjustment knob 100 will either "loosen" or "tighten" the tension of torsion spring 96 and thereby will place axle 60 under either a lesser or greater degree of restraint, which provides a tension adjustment for back support 20.

Axle 60 also includes a stop mechanism. A pair of stop pins 110 extend crosswise through holes in axle 60; when axle is installed, stop pins 110 will be in alignment with and positioned above a set of front stops (not visible) and back stops 112 (shown partially in FIG. 6) formed in yoke housing 80. (The front stops and the back stops have generally the same configuration.) Front stops and back stops 112 limit the range of motion of rotatable axle 60 within yoke housing 80. When axle 60 is rotated to the forward limit of the range of motion, for example when brought under a preload tension by torsion spring 96 through adjustment knob 100, stop pins 110 will be brought into contact with the front stops; when axle 60 is rotated in the opposite direction to the backward limit of the range of motion, for example when back support 20 is driven toward a reclined position, stop pins 110 will be brought into contact with the back stops 112. According to alternative embodiments, any other type of tensioning mechanism or stop mechanism and/or other associated structures relating to the back support and seat assembly may be used.

Figure 5:
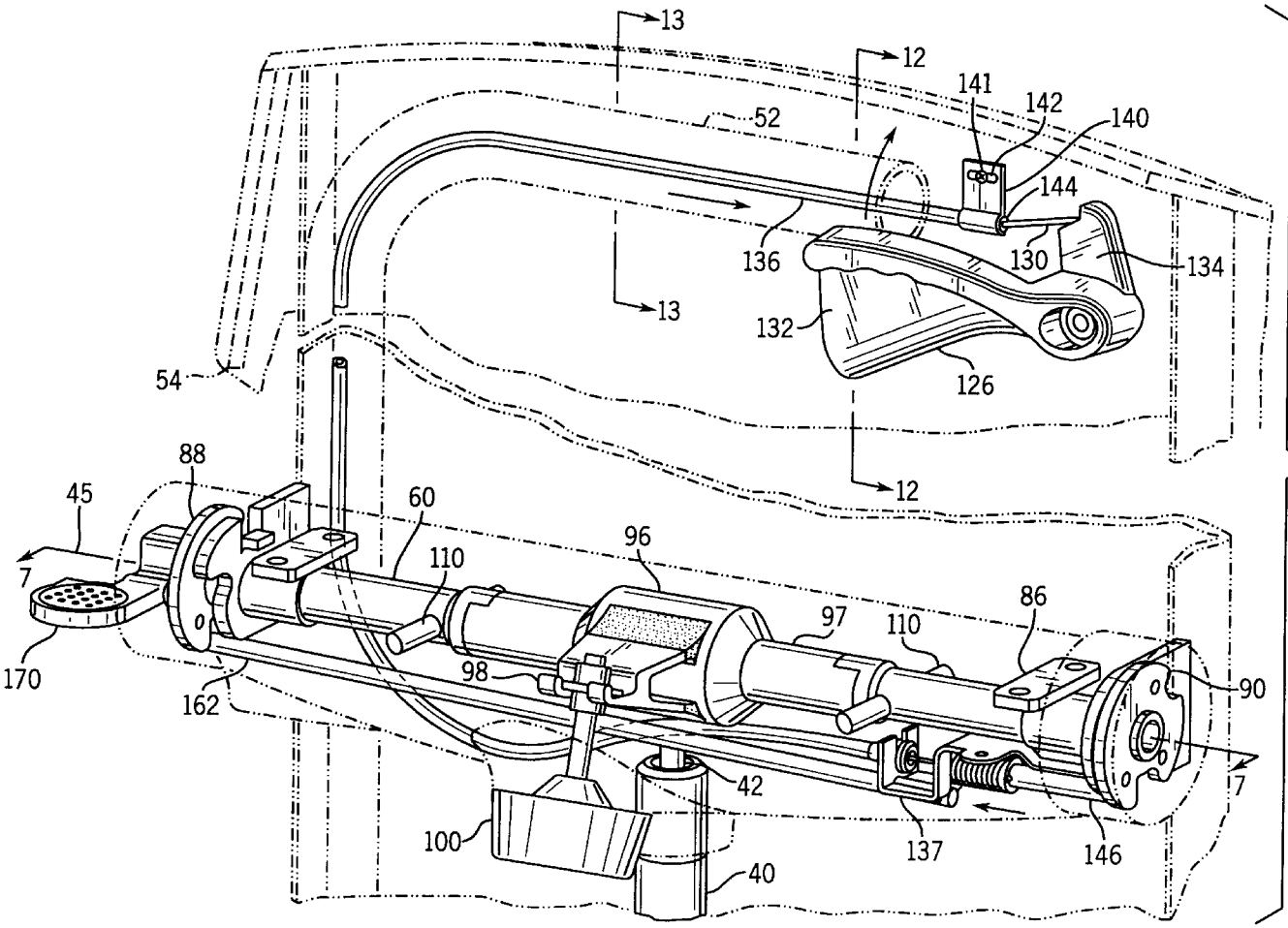
FIG. 5 is a fragmentary perspective view of the seat with the yoke and the pedestal of the chair.
Figure 17:
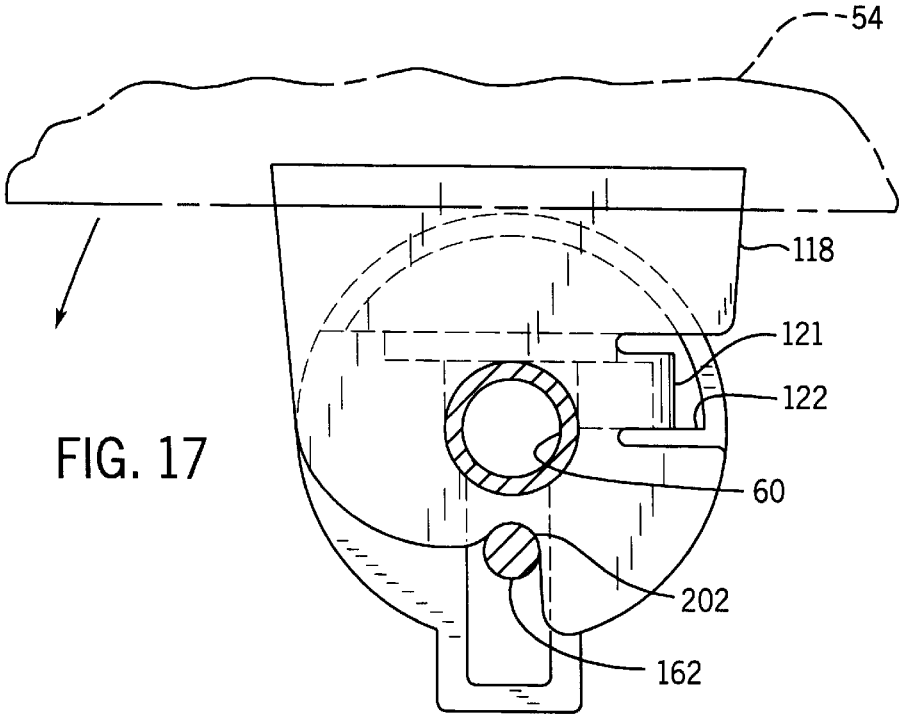
FIG. 17 is a sectional elevation view of the yoke of the chair taken along line 17—17 in FIG. 7 showing the mounting structure for the seat oriented in an "in use" position.
Figure 18:
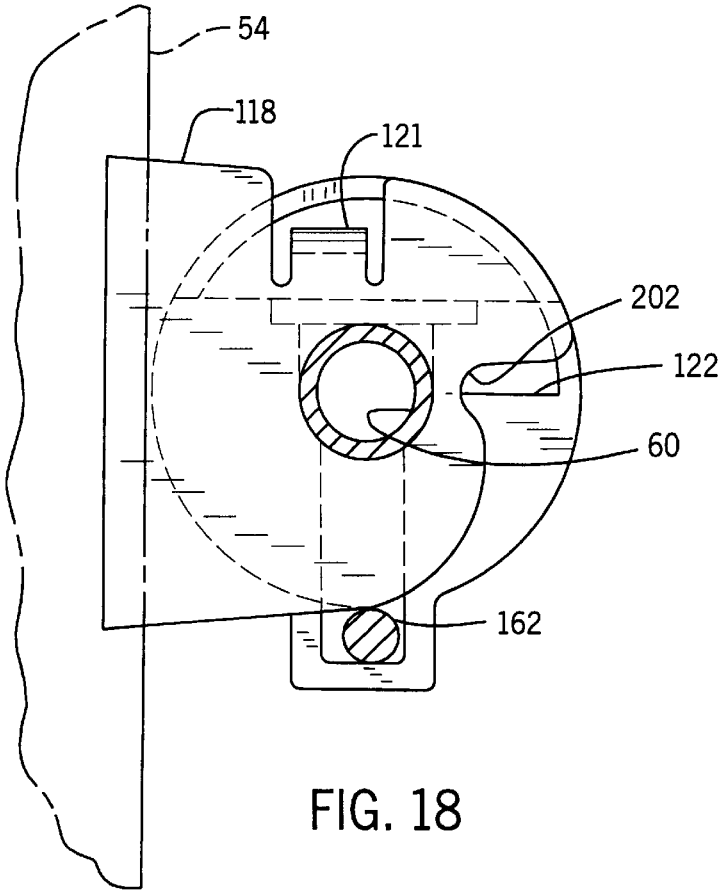
FIG. 18 is a sectional elevation view showing the mounting structure of FIG. 17 oriented in a stowed position.

Seat tube 50 (i.e. mounting structure for seat 18) includes cross member 52 (shown in phantom lines) and two parallel lateral members 54 and 56 (visible in FIG. 2 but not shown in FIGS. 5 through 7). Right lateral member 54 of seat tube 50 has a mounting flange shown as a right ear 118; left lateral member 56 of seat tube 50 has a mounting flange shown as a left ear 120. Each mounting flange 118 and 120 has a central mounting hole 117 which is mounted onto axle 60 to allow for pivotal rotation of seat 18 with respect to yoke 24 (and therefore with respect to base 12) independently of the rotation of axle 60 in a range of motion between the generally horizontal "in use" position and the generally vertical stowed position. As shown in FIGS. 17 through 19, mounting flanges 118 and 120 include tabs 121 which come into contact with a ledge 122 formed in the yoke housing 80 and serve as a "stop" when seat 18 has been rotated forward to the "in use" position.

In ordinary use, seat 18 of chair 10 is retained in the "in use" position by a latch mechanism 124. Associated with latch mechanism 124 is a latch release handle 126 mounted beneath seat outer shell 58; a cable 130 extends from latch release handle 126 to latch mechanism 124 (which is cable actuated). Latch release handle 126 is pivotally mounted on a bushing for rotation between a release position (in which cable 130 is drawn from latch mechanism 124) and a latched position (in which cable 130 is drawn toward latch mechanism 124). Latch release handle 126 includes a grip portion 132 and a tensioning portion 134 into which cable 130 is secured. As shown in FIGS. 12 and 13, cable 130 and outer sleeve or conduit 136 are stowed in a channel 138 beneath seat outer shell 58 and is retained in channel 138 by seat tube 50.

At one end, cable 130 is thus mounted beneath seat outer shell 58 by an end fitting 140 which is secured to seat, outer shell 58 by a fastener shown as a screw 141 retained within a mounting slot 142; end fitting 140 has a groove 144 within conduit 136 (or cable shield) can be tightly secured (i.e. grasped), with cable 130 extending therethrough (for securing to tensioning portion 134 of latch release handle 126). The tension of cable 130 can be adjusted (slightly) by slidably or rotatably adjusting the position of end fitting 140 along or within mounting slot 142 with respect to screw 141.

At its opposite end, cable 130 is secured at latch mechanism 124 within the bore of a latch pin 146 by a set screw 145. As shown in FIGS. 15 and 16, latch pin 146 slides between a latched position (as in FIG. 15) and a release position (as in FIG. 16) retained by a latch cap 137 within a groove 212 within yoke housing 80. In the latched position, latch pin 146 engages left ear 120 of the mounting structure for seat 18 and thereby prevents rotation of seat 18 with respect to yoke 24. Left ear 120 includes an aperture 125 into which a tapered or angled end 147 of latch pin 146 is inserted; aperture 125 is reinforced by a latch insert 123 (made of a hardened metal) secured to left ear 120 by a fastener shown as a screw 208. (Upon engagement with latch pin 146, latch insert 123 also provides a "stop" when seat 18 has been rotated in the rearward direction.) In the release position, latch pin 146 has been withdrawn from engagement with left ear 120 so that seat 18 may be rotated with respect to yoke 24, for example to the stowed position.

Latch mechanism 124 includes latch cap 137 mounted within yoke housing 80 (by fasteners shown as screw 11il engaging mounting holes 152 on mounting tabs 154, see FIGS. 14 through 16). Latch cap 137 is formed with a slot 153 into which an end fitting 128 for cable 130 and conduit 136 is inserted; when end fitting 128 has been installed, cable 130 and conduit 136 are in alignment with latch pin 146 (see FIGS. 15 and 16). Latch mechanism 124 also includes a return spring 156 tending to bias latch pin 146 into a latched position (see FIG. 15); return spring 156 is fitted around latch pin 146 and retained between a roll pin 158 inserted through latch pin 146 and the side wall 160 of latch cap 137. Latch mechanism 124 is intended to provide for "self-locking" so that when seat 18 is rotated into the "in use" position and aperture 125 of left ear is brought into alignment with latch pin 146, return spring 156 will guide angled end 147 of latch pin 146 into aperture 125 and engagement with latch insert 123.

Latch mechanism 124 is thus operated by latch release handle 126. When grip portion 132 is lifted, tensioning portion 134 draws cable 130 into end fitting 128 of latch mechanism 124; latch pin 146 is drawn against return spring 156 out of engagement with left ear 120. Seat 18 is free to be rotated to the stowed,position. When grip portion 132 is released, return spring 156 will urge the flat leading edge of latch pin 146 into contact with left ear 120; when seat 18 is rotated so that aperture 125 of left ear 120 is brought into alignment with latch pin 146, angled end 147 of latch pin 146 will then be guided and driven into aperture 125. Seat 18 is secured in the "in use" position.

As shown in FIGS. 5 through 7, a yoke wire 162 extends along and beneath transverse axle 60 of yoke 24. Yoke wire 162 includes a bend 164 with a spherical domed end 166. Yoke wire 162 is pivotally mounted at the other end within yoke housing 80 beneath latch cap 137 by a yoke wire axle 163 (mounted at each end in a journal 168, see FIG. 11). Domed end 166 of yoke wire 162 is thus free to travel upward and downward within a predetermined path of travel. As shown in FIGS. 7 and 10, under ordinary operating conditions, yoke wire 162 rests on button 42 (i.e. release valve mechanism) at the top of strut 40 of pneumatic cylinder 38 within pedestal 14 of base 12.

Figure 8:
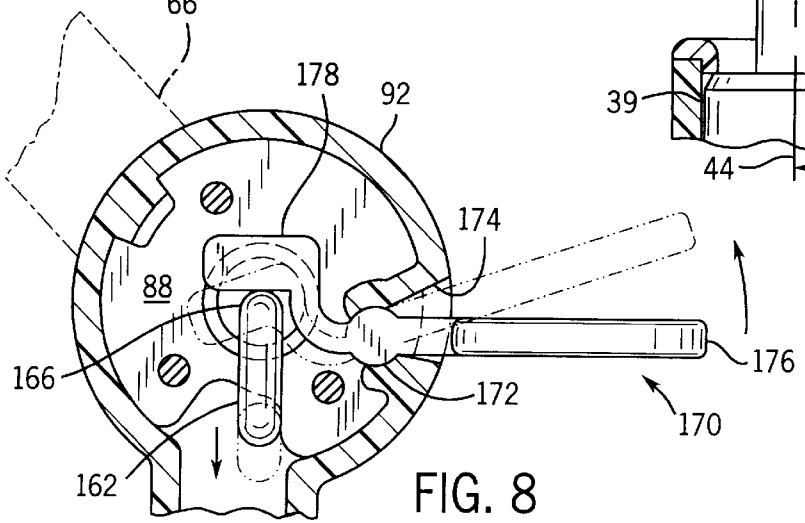
FIG. 8 is a sectional elevation view of the yoke of the chair taken along line 8—8 in FIG. 7.

Yoke 24 includes a seat height adjustment mechanism including a paddle 170 associated with yoke wire 162. As shown in FIG. 8, paddle 170 is installed through an opening 174 in left circular cap 92 of left support member 66 of back support 20 associated with yoke 24. Paddle 170 includes an exposed paddle portion 176 and an actuator portion 178 (within left circular cap 92) and in contact with domed end 166 of yoke wire 162. Paddle 170 also includes an integral axle section 172 (i.e. a bead of material) about which paddle 170 pivots within opening 174. Actuator portion 178 of paddle 170 urges domed end 166 of yoke wire 162 downward when paddle portion 176 of paddle 170 is lifted.

In operation of the seat height adjustment mechanism, when paddle portion 176 of paddle 170 is lifted, button 42 of the release valve mechanism of pneumatic cylinder 38 is depressed. Height adjustment of seat assembly 16 with respect to base 12 may be effected Seat assembly 16 may be lowered by lowering strut 40 into body 39 of pneumatic cylinder 38; seat assembly 16 may be raised by allowing strut 40 to rise within body 39 of pneumatic cylinder 38. (In the normal operating condition, button 42 of release valve mechanism at the top of strut 40 of pneumatic cylinder projects upward under the pressure force of the fluid, e.g. gas or air, contained in pneumatic cylinder 38.)

Yoke 24 also includes the seat-activated mechanism by which the height of the seat assembly is automatically set to a predetermined height with respect to the base when the seat is rotated to the stowed position. When seat 18 is in the horizontal "in use" position, yoke wire 162 rests lightly on button 42 of the release valve mechanism at the top of strut 40 of pneumatic cylinder 38. The release valve mechanism has not been actuated (i.e. button has not been depressed) and strut 40 maintains its existing position within body 39 of pneumatic cylinder 38. As shown in FIG. 17, yoke wire 162 rests snugly in a recess 202 formed on the perimeter of right ear 118 of the mounting structure for seat 18, held in place by an upward force provided by button 42 of the release valve mechanism of pneumatic cylinder 38. (Height adjustment of seat assembly 16 can be effected by the seat height adjustment mechanism.) As seat 18 is rotated to the stowed position, yoke wire 162 will be urged out of recess 202 and will be driven downward as the perimeter of right ear 118 (which acts as a cam) bears on the top surface of yoke wire 162. As shown in FIG. 18, once seat 18 has been rotated to the stowed position, yoke wire 162 has been driven and is held downward downward (at or near the end of range of motion). Button 42 of the release valve mechanism of pneumatic cylinder 38 has been depressed and is held downward; seat assembly 16 will therefore be raised upward by strut 40 to a predetermined height (e.g. corresponding to the full path of upward travel of strut 40 within body 39 of pneumatic cylinder 38). As a result, when the seat of each chair is rotated to the stowed position, the seat assembly of each chair to be nested will be brought to a uniform height suitable for purposes of nesting. (When seat 18 is rotated back to the "in use" position, the height of seat assembly 16 is once again brought under the control of the seat height adjustment mechanism.)

Seat 18 and core 30 of base 12 provide a coacting locking or "registration" mechanism so that the rotational position of the seat assembly with respect to the base can be registered in a fixed orientation (e.g. with seat assembly 16 in alignment with base 12). Seat assembly 16 is ordinarily rotatable about central axis 44 with respect to pedestal 14 of base 12. According to a particularly preferred embodiment, the base of each chair is configured to provide for a secure nestable "fit" of one chair within another chair for purposes of nesting (e.g. one base within another base). As shown in the FIG. 3, rear legs 28 of chair 10*b* are configured to form a receiving area or receptacle 29 within which front legs 26 of chair 10*a* can be received (see also FIG. 1A). When the chairs are to be nested, therefore, it is preferred that the base of each chair be brought into uniform alignment with the seat assembly of the chair (for all chairs to be nested) to provide more efficiently for nesting (e.g. for improved storage density and mobility).

As shown in FIGS. 20 through 23, registration of seat 18 with base 12 is accomplished through a "tooth and slot" arrangement. According to any particularly preferred embodiment, the tooth and the slot will be provided with a mating frictional fit (e.g. friction ramp angles) that allow selective engagement in a sufficiently secure manner (but does not subject the tooth or the slot to damage under "abuse" or undue loading). Referring to FIGS. 20 and 21, core 30 of base 12 is provided with a circular cap ring 180 (secured by screws 183) having a curved tooth 182 projecting upward and outward; seat 18 is provided with a slot or groove 184 (e.g centrally formed beneath the rear edge of seat outer shell 58). When seat assembly 16 has been rotated to the proper orientation for registration with respect to base 12, tooth 182 is engaged by friction and retained in groove 184. According to an alternative embodiment shown in FIGS. 22 and 23 (wherein the tooth and slot are reversed), core 30 of base 12 is provided with a circular cap ring 181 (secured by screws 189) provided with a slot 187; a tooth assembly 186 including a projecting seat tooth 188 is mounted to seat 18 (e.g. centrally mounted beneath the rear edge of seat outer shell 58 by screws 210). When seat assembly 16 has been rotated to the proper orientation with respect to base 12, seat tooth 188 is engaged and retained in slot 187. As a result, the seat assembly of each of the chairs to be nested will be placed in a uniform rotational orientation suitable for purposes of nesting. According to any preferred embodiment, the "registered" position of the seat assembly with respect to the base of chair will be maintained during the ordinary forces encountered during nesting of the chairs, storage and/or arrangement of "trains" of nested chairs (while protecting the tooth and/or slot from breakage). For example, according to a particularly preferred embodiment, the tooth and slot are configured so that under a side load of greater than 30 pounds force, or if the seat is driven downward, the tooth will "pop" out of the slot (e.g. by suitably shaping the tooth and/or the slot).

Figure 24:
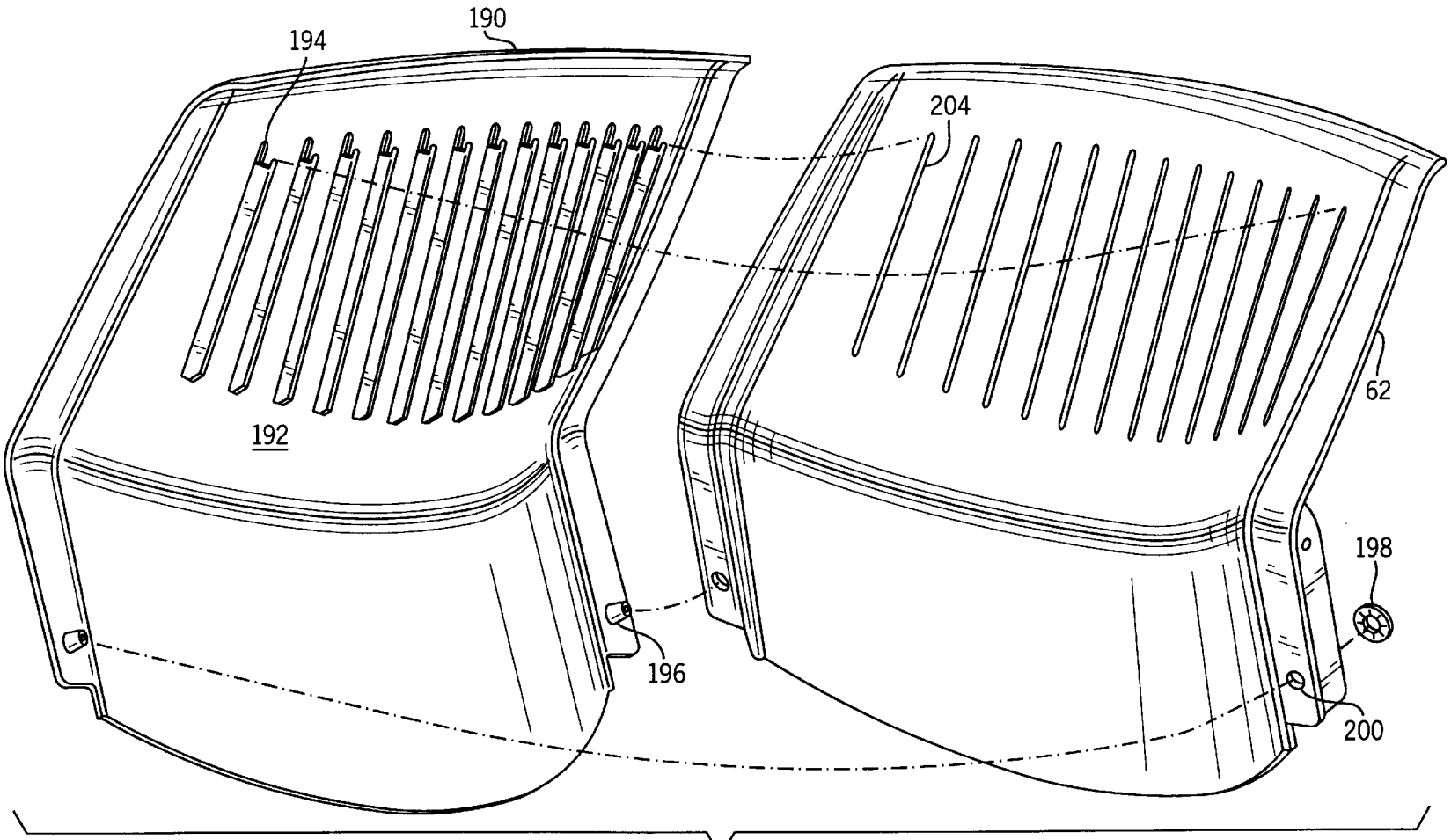
FIG. 24 is an exploded perspective view of the back outer shell and an upholstered cover of the chair according to an alternative embodiment.
Figure 25:
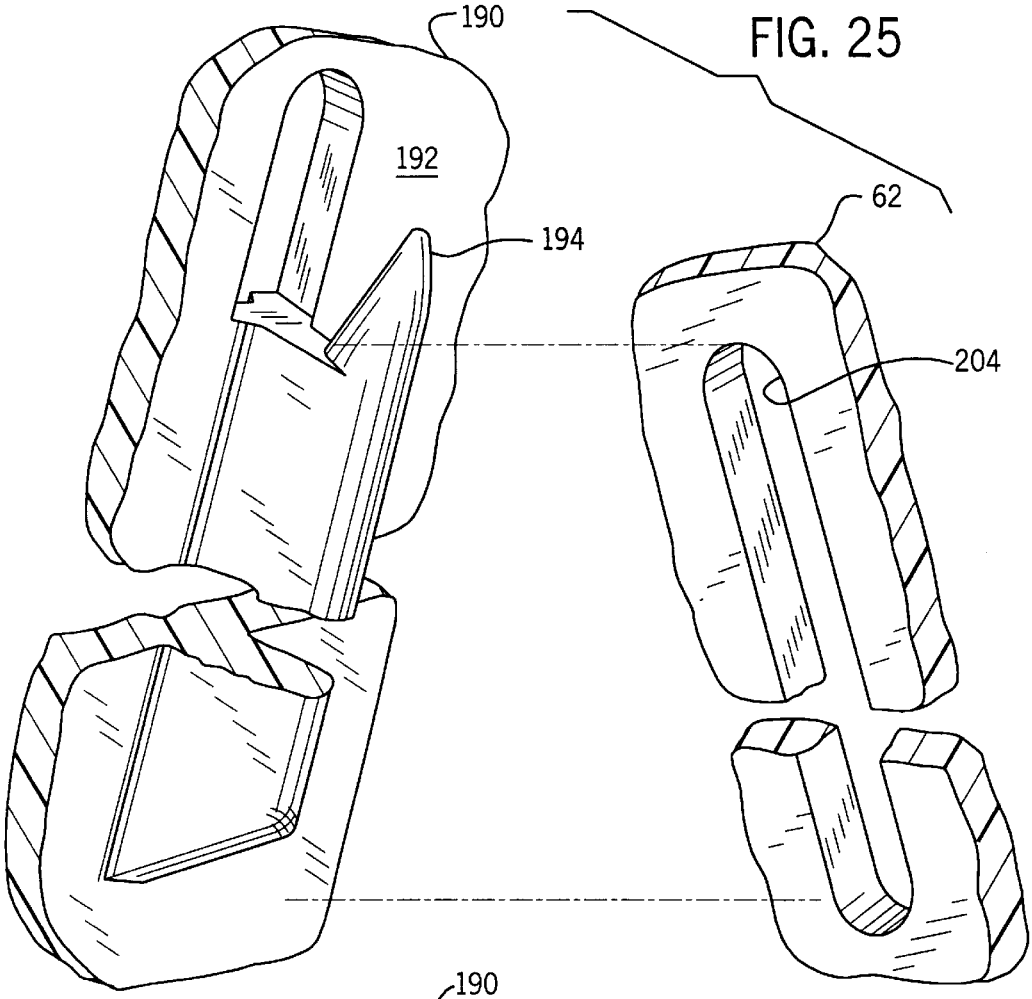
FIG. 25 is a fragmented exploded perspective view of the detail of attachment of the upholstered cover and the back outer cover shown in FIG. 24.
Figure 26:
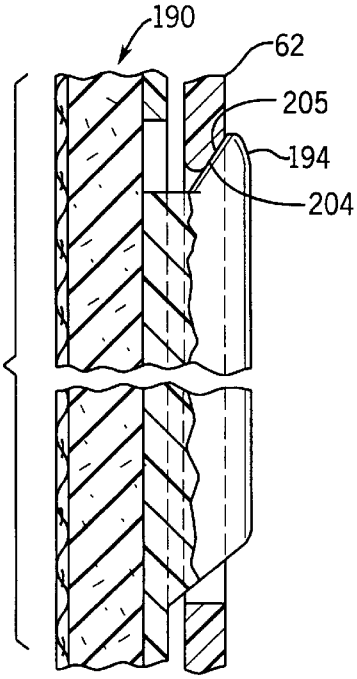
FIG. 26 is a fragmentary sectional elevation view of the detail of FIG. 25.
Figure 27:
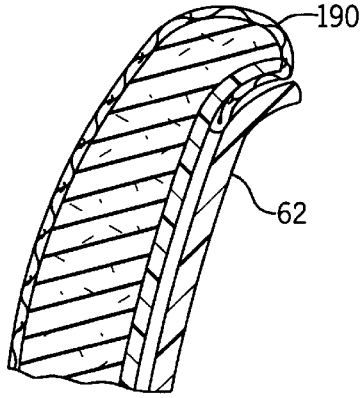
FIG. 27 is a fragmentary sectional elevation view of the detail of attachment of the upholstered cover to the back outer shell shown in FIG. 24.

According to a particularly preferred embodiment, the seat outer shell and back outer shell of the chair each can be provided with an upholstered cover (e.g. fabric and foam). A fabric and foam cover can be mounted to the seat outer shell by a plurality of threaded fasteners that art secured at mounting points, for example, located beneath the seat outer shell. Likewise, as shown in FIGS. 24 through 27, an upholstered cover 190 can also be mounted to back outer shell 62. Inner surface 192 of upholstered cover 190 includes a series of hooks 194 (e.g. plastic) that are fit for insertion within corresponding slots 204 (having a chamfer 205) through back outer shell 62. As shown in FIG. 26, after insertion hooks 194 securely hold upholstered cover 190 to back outer shell 62. (According to an alternative embodiment, an upholstered cover may be mounted to the seat outer shell in a similar hook and slot arrangement.) As shown in FIG. 24, upholstered cover 190 may also include bosses 196 which can be pressed into correspondingly positioned apertures 200 on back outer shell 62 and secured by a ring fastener 198 (e.g. a locking washer). According to alternative embodiments, various other arrangements for providing an upholstered cover to the seat and back support of the chair may be employed; for example, compliant hooks or other types of fasteners or fastening systems (e.g. interference or compliant fits, adhesives, etc.), either alone or in any suitable combination, may be employed.

Although only a few exemplary embodiments of this invention have been described in detail above, those skilled in the art who review this disclosure will readily appreciate that many modifications are possible in the exemplary embodiments without materially departing from the novel teachings and advantages of the present invention. According to the preferred and alternative embodiments, the elements of the chair can be made of any suitable materials known to those of skill in the art who may review this disclosure. For example, the yoke housing may be made of aluminum (with a plastic yoke cap); the paddle of ABS plastic, as are the outer shells and the latch release handle; the base (legs) of die cast aluminum; the pneumatic cylinder (e.g. gas spring) is of a type sold by Stabilus of Colmar, Pa.; the latch pin and latch insert are a hardened steel (8620, Rockwell 64); the rub strips are made of polypropylene; the "tooth and slot" may be nylon; various metal parts, such as the structural members of the seat assembly and various adjustment mechanisms may be made of any suitable metal, for example cold rolled steel.

According to alternative embodiments, the elements of the chair, such as the base, support assembly or seat assembly, may be given other configurations that interrelate or function according to the claimed invention. Accordingly, all such modifications are intended to be included within the scope of the invention as defined in the following claims. In the claims, each means-plus-function clause is intended to cover the structures described herein as performing the recited function and not only structural equivalents but also equivalent structures.

Other substitutions, modifications, changes and omissions may be made in the design, operating conditions and arrangement of the preferred embodiments without departing from the spirit of the invention as expressed in the appended claims.

What is claimed is:

1. A method of storing a chair having a seat assembly adapted for rotational movement and for vertical movement relative to a base comprising:

adjusting the vertical height of the seat assembly relative to the base;

orienting the rotational position of the seat assembly relative to the base; and horizontally nesting the base in a base of another similarly configured chair.

2. The method of claim 1 further comprising horizontally nesting the seat assembly in a seat assembly of the similarly configured chair.

3. The method of claim 2 further comprising horizontally nesting the seat assembly in the seat assembly of the similarly configured chair.

4. The method of claim 3 wherein the height of the seat assembly is configured for positioning at a height substantially the same as a height of the seat assembly of the similarly configured chair.

5. The method of claim 4 further comprising registering the height of the seat assembly relative to the base.

6. The method of claim 5 further comprising registering a pivotal orientation of the seat assembly when in a generally vertical position.

7. The method of claim 6 further comprising locking the pivotal orientation of the seat assembly in the generally vertical position.

8. The method of claim 7 further comprising indicating when the seat assembly is positioned for nesting.

9. The method of claim 1 further comprising fitting a portion of the base under a portion of the similarly configured chair.

10. The method of claim 1 wherein the height of the seat assembly is configured for positioning at a height substantially the same as a height of a seat assembly of the similarly configured chair.

11. The method of claim 1 further comprising registering the height of the seat assembly relative to the base.

12. The method of claim 1 further comprising registering a pivotal orientation of the seat assembly when in a generally vertical position.

13. The method of claim 12 further comprising locking the pivotal orientation of the seat assembly in the generally vertical position.

14. The method of claim 12 further comprising indicating when the seat assembly is positioned for nesting.

15. A base for an article of furniture comprising:

a hub; and a plurality of legs coupled to the hub comprising a first set of legs being positioned at a generally higher elevation than a second set of legs;

wherein at least a portion of the first set of legs can be positioned generally above a portion of the second set of legs of a similar base so as to at least partially nest with the similar base.

16. The base of claim 15 wherein a substantial portion of each of the first set of legs is positioned at a generally higher elevation than a substantial portion of each of the second set of legs.

17. The base of claim 15 wherein the first set of legs are connected to the hub at a generally higher elevation than the second set of legs.

18. The base of claim 15 wherein the legs generally angle downward away from the hub and wherein portions of each of the first set of legs are positioned at generally higher elevations than corresponding portions of the second set of legs.

19. The base of claim 15 wherein the hub is substantially centrally positioned relative to the legs.

20. The base of claim 15 wherein the first set of legs comprises a pair of legs.

21. The base of claim 15 wherein the second set of legs comprises a pair of legs.

22. The base of claim 15 wherein the first set of legs are positioned a greater distance apart than the second set of legs.

23. The base of claim 15 wherein the legs are substantially straight.

24. The base of claim 15 wherein the first set of legs includes at least one rub strip to at least partially reduce damage to the legs during nesting.

25. The base of claim 15 further comprising the base being configured for a chair.

26. The base of claim 15 further comprising at least one stop for limiting the extent the base may nest within another base.

27. The base of claim 26 wherein the stop is mounted on the base.

28. The base of claim 27 wherein the stop is mounted on the first set of legs.

29. The base of claim 15 wherein the legs are radially arranged relative to the hub and generally slant downward away from the hub.

30. The base of claim 29 wherein portions of each of the first set of legs are positioned at generally higher elevations than corresponding portions of the second set of legs.

31. The base of claim 30 further comprising at least one stop for limiting the extent one base may nest within another.

32. The base of claim 31 wherein the stop is mounted on the first set of legs.

33. The base of claim 32 wherein the first set of legs comprises a pair of legs.

34. The base of claim 33 wherein the second set of legs comprises a pair of legs.

35. The base of claim 34 wherein the first pair of legs are positioned apart a greater distance than are the second pair of legs.

36. The base of claim 35 wherein the hub is substantially centrally positioned relative to the legs.

37. The base of claim 36 wherein the first set of legs are connected to the hub at a higher elevation than the second set of legs.

38. The base of claim 37 wherein the legs are substantially straight.

39. The base of claim 38 wherein the first pair of legs includes at least one rub strip to at least partially reduce damage to the legs during nesting.

40. The base of claim 39 further comprising the base being configured for a chair.

41. A nestable chair for use in a work environment comprising:

a base comprising a nesting portion and a nested portion;

a pedestal coupled to the base; and a seat assembly coupled to the pedestal and adapted for pivotal movement with respect to the base;

wherein the base is configured to allow for horizontal nesting within the base.

42. The chair of claim 41 further comprising at least one stop for limiting the extent the base may nest within another base.

43. The chair of claim 41 wherein the base comprises a hub and a plurality of legs.

44. The chair of claim 43 wherein a first set of the legs is generally positioned at a higher elevation than a second set of the legs such that at least a portion of the first set of legs can be positioned generally above a portion of a second set of legs of the base.

45. The chair of claim 43 wherein the hub is substantially centrally positioned relative to the legs.

46. The chair of claim 44 further comprising at least one stop for limiting the extent the base may nest within another base.

47. The chair of claim 46 wherein the stop is mounted on the base.

48. The chair of claim 46 wherein the first set of legs are attached to the hub at a generally higher elevation than the second set of legs.

49. The chair of claim 43 wherein the seat assembly is configured to allow for horizontal nesting within the seat assembly.

50. The chair of claim 49 wherein the seat assembly is configured for nesting in a seat assembly of another chair at a generally uniform height relative to the base.

51. The chair of claim 49 wherein at least two bases of at least two chairs may be fit together in a nested arrangement.

52. The chair of claim 49 wherein at least two seat assemblies may be fit together in a nested arrangement.

53. The chair of claim 49 wherein the nesting portion provides a receptacle for receiving the nested portion.

54. The chair of claim 49 wherein the height of the seat assembly can be automatically adjusted to a reference position for nesting.

55. The chair of claim 49 wherein the vertical height of a seat of the seat assembly may be adjusted to a generally uniform height for nesting.

56. The chair of claim 49 wherein the seat assembly is configured for nesting between two arms.

57. The chair of claim 41 wherein the nesting portion is generally positioned at a higher elevation than the nested portion such that the nesting portion is adapted to receive the nested portion.

58. A nestable chair for use in a work environment comprising:

a base;

a pedestal coupled to the base;

a seat assembly coupled to the pedestal and adapted for pivotal movement with respect to the base; and at least one stop for limiting the extent the base may nest within the base;

wherein the base is configured to allow for horizontal nesting within the base.

59. The chair of claim 58 wherein the base includes a nesting portion and a nested portion.

60. The chair of claim 59 wherein the nesting portion is generally positioned at a higher elevation than the nested portion such that the nesting portion is adapted to receive the nested portion.

61. The chair of claim 60 wherein the nesting portion provides a receptacle for receiving the nested portion.

62. The chair of claim 60 wherein the height of the seat assembly can be automatically adjusted to a reference position for nesting.

63. The chair of claim 60 wherein the vertical height of a seat of the seat assembly may be adjusted to a generally uniform height for nesting.

64. The chair of claim 60 wherein the seat assembly is configured for nesting between two arms.

65. The chair of claim 58 wherein the base comprises a hub and a plurality of legs.

66. The chair of claim 65 wherein a first set of the legs is generally positioned at a higher elevation than a second set of the legs such that at least a portion of the first set of legs can be positioned generally above a portion of a second set of legs of the base.

67. The chair of claim 65 wherein the hub is substantially centrally positioned relative to the legs.

68. The chair of claim 66 further comprising at least one stop for limiting the extent the base may nest within another base.

69. The chair of claim 68 wherein the stop is mounted on the base.

70. The chair of claim 68 wherein the first set of legs are attached to the hub at a generally higher elevation than the second set of legs.

71. The chair of claim 65 wherein the seat assembly is configured to allow for horizontal nesting within the seat assembly.

72. The chair of claim 71 wherein the seat assembly is configured for nesting in a seat assembly of another chair at a generally uniform height relative to the base.

73. The chair of claim 71 wherein at least two bases of at least two chairs may be fit together in a nested arrangement.

74. The chair of claim 71 wherein at least two seat assemblies may be fit together in a nested arrangement.

75. A nestable chair for use in a work environment comprising:

a base comprising a hub and a plurality of legs;

a pedestal coupled to the base; and a seat assembly coupled to the pedestal and adapted for pivotal movement with respect to the base;

wherein the base is configured to allow for horizontal nesting within the base.

76. The chair of claim 75 wherein the base includes a nesting portion and a nested portion.

77. The chair of claim 76 wherein the nesting portion is generally positioned at a higher elevation than the nested portion such that the nesting portion is adapted to receive the nested portion.

78. The chair of claim 77 wherein the nesting portion provides a receptacle for receiving the nested portion.

79. The chair of claim 77 wherein the height of the seat assembly can be automatically adjusted to a reference position for nesting.

80. The chair of claim 77 wherein the vertical height of a seat of the seat assembly may be adjusted to a generally uniform height for nesting.

81. The chair of claim 77 wherein the seat assembly is configured for nesting between two arms.

82. The chair of claim 75 wherein the seat assembly is configured to allow for horizontal nesting within the seat assembly.

83. The chair of claim 82 wherein the seat assembly is configured for nesting in a seat assembly of another chair at a generally uniform height relative to the base.

84. The chair of claim 82 wherein at least two bases of at least two chairs may be fit together in a nested arrangement.

85. The chair of claim 82 wherein at least two seat assemblies may be fit together in a nested arrangement.

86. The chair of claim 75 further comprising at least one stop for limiting the extent the base may nest within another base.

87. The chair of claim 75 wherein a first set of the legs is generally positioned at a higher elevation than a second set of the legs such that at least a portion of the first set of legs can be positioned generally above a portion of a second set of legs of the base.

88. The chair of claim 75 wherein the hub is substantially centrally positioned relative to the legs.

89. The chair of claim 87 further comprising at least one stop for limiting the extent the base may nest within another base.

90. The chair of claim 89 wherein the stop is mounted on the base.

91. The chair of claim 89 wherein the first set of legs are attached to the hub at a generally higher elevation than the second set of legs.

92. A nestable chair for use in a work environment comprising:

a base;

a pedestal coupled to the base; and a seat assembly coupled to the pedestal and adapted for pivotal movement with respect to the base, wherein the height of the seat assembly is adapted to be automatically adjusted to a reference position for nesting;

wherein the base is configured to allow for horizontal nesting within the base and the seat assembly is configured to allow for horizontal nesting within the seat assembly.

93. The chair of claim 92 wherein the base includes a nesting portion and a nested portion.

94. The chair of claim 93 wherein the nesting portion is generally positioned at a higher elevation than the nested portion such that the nesting portion is adapted to receive the nested portion.

95. The chair of claim 94 wherein the nesting portion provides a receptacle for receiving the nested portion.

96. The chair of claim 92 wherein the base comprises a hub and a plurality of legs.

97. The chair of claim 96 wherein a first set of the legs is generally positioned at a higher elevation than a second set of the legs such that at least a portion of the first set of legs can be positioned generally above a portion of a second set of legs of the base.

98. The chair of claim 96 wherein the hub is substantially centrally positioned relative to the legs.

99. The chair of claim 97 further comprising at least one stop for limiting the extent the base may nest within another base.

100. The chair of claim 99 wherein the stop is mounted on the base.

101. The chair of claim 99 wherein the first set of legs are attached to the hub at a generally higher elevation than the second set of legs.

102. The chair of claim 92 further comprising at least one stop for limiting the extent the base may nest within another base.

103. The chair of claim 92 wherein the seat assembly is configured for nesting in a seat assembly of another chair at a generally uniform height relative to the base.

104. The chair of claim 92 wherein at least two bases of at least two chairs may be fit together in a nested arrangement.

105. The chair of claim 92 wherein at least two seat assemblies may be fit together in a nested arrangement.

106. The chair of claim 92 wherein the vertical height of a seat of the seat assembly may be adjusted to a generally uniform height for nesting.

107. The chair of claim 92 wherein the seat assembly is configured for nesting between two arms.

108. A nestable chair for use in a work environment comprising:

a base;

a pedestal coupled to the base; and a seat assembly coupled to the pedestal and adapted for pivotal movement with respect to the base and comprising a seat adapted so that the vertical height of the seat may be adjusted to a generally uniform height for nesting;

wherein the bases configured to allow for horizontal nesting within the base and the seat assembly is configured to allow for horizontal nesting within the seat assembly.

109. The chair of claim 108 wherein the base includes a nesting portion and a nested portion.

110. The chair of claim 109 wherein the nesting portion is generally positioned at a higher elevation than the nested portion such that the nesting portion is adapted to receive the nested portion.

111. The chair of claim 110 wherein the nesting portion provides a receptacle for receiving the nested portion.

112. The chair of claim 108 wherein the base comprises a hub and a plurality of legs.

113. The chair of claim 112 wherein a first set of the legs is generally positioned at a higher elevation than a second set of the legs such that at least a portion of the first set of legs can be positioned generally above a portion of a second set of legs of the base.

114. The chair of claim 112 wherein the hub is substantially centrally positioned relative to the legs.

115. The chair of claim 113 further comprising at least one stop for limiting the extent the base may nest within another base.

116. The chair of claim 115 wherein the stop is mounted on the base.

117. The chair of claim 115 wherein the first set of legs are attached to the hub at a generally higher elevation than the second set of legs.

118. The chair of claim 108 further comprising at least one stop for limiting the extent the base may nest within another base.

119. The chair of claim 108 wherein the seat assembly is configured for nesting in a seat assembly of another chair at a generally uniform height relative to the base.

120. The chair of claim 108 wherein at least two bases of at least two chairs may be fit together in a nested arrangement.

121. The chair of claim 108 wherein at least two seat assemblies may be fit together in a nested arrangement.

122. The chair of claim 108 wherein the height of the seat assembly can be automatically adjusted to a reference position for nesting.

123. The chair of claim 108 wherein the seat assembly is configured for nesting between two arms.

124. The base of claim 15 wherein the first set of legs include an upper surface and a lower surface and the second set of legs include an upper surface and a lower surface so that a point on the lower surface of the first set of legs is positioned above a point on the upper surface of the second set of legs.

125. The base of claim 124 wherein the first set of legs are vertically raised relative to the second set of legs.

126. The base of claim 125 wherein the upper surface of the second set of legs are configured to fit underneath the lower surface of the first set of legs.

127. The base of claim 126 wherein the lower surface of the first set of legs comprises an underside.

128. The base of claim 124 wherein the first set of legs extend radially from the hub.

129. The base of claim 124 wherein the first set of legs has a tapered profile.

130. The base of claim 129 wherein the second set of legs has a tapered profile.

* * * * *